US008647179B2

(12) United States Patent
Nakayama et al.

(10) Patent No.: US 8,647,179 B2
(45) Date of Patent: Feb. 11, 2014

(54) POLISHING PAD, AND METHOD FOR MANUFACTURING POLISHING PAD

(75) Inventors: Kimio Nakayama, Kurashiki (JP); Nobuo Takaoka, Kurashiki (JP); Mitsuru Kato, Kurashiki (JP); Hirofumi Kikuchi, Kurashiki (JP); Jiro Tanaka, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 1179 days.

(21) Appl. No.: 12/525,555

(22) PCT Filed: Feb. 1, 2008

(86) PCT No.: PCT/JP2008/051688

§ 371 (c)(1),
(2), (4) Date: Aug. 3, 2009

(87) PCT Pub. No.: WO2008/093850

PCT Pub. Date: Aug. 7, 2008

(65) Prior Publication Data

US 2010/0087128 A1 Apr. 8, 2010

(30) Foreign Application Priority Data

Feb. 1, 2007 (JP) ..... 2007-023372
Feb. 1, 2007 (JP) ..... 2007-023373
Feb. 1, 2007 (JP) ..... 2007-023374

(51) Int. Cl.
*B24D 11/00* (2006.01)

(52) U.S. Cl.
USPC ..... 451/526; 451/534

(58) Field of Classification Search
USPC ..... 451/526, 527, 533, 534, 536; 51/293, 51/297, 298
See application file for complete search history.

(56) References Cited

U.S. PATENT DOCUMENTS

| | | | |
|---|---|---|---|
| 5,944,589 | A | 8/1999 | Nakajima |
| 6,800,019 | B2 | 10/2004 | Tanaka et al. |
| 2003/0013382 | A1 | 1/2003 | Tanaka et al. |
| 2003/0100250 | A1 | 5/2003 | West, Jr. |
| 2003/0133382 | A1 | 7/2003 | Fukushima |
| 2006/0199473 | A1 | 9/2006 | Suzuki et al. |

FOREIGN PATENT DOCUMENTS

| | | |
|---|---|---|
| JP | 3-234475 | 10/1991 |
| JP | 10-128674 | 5/1998 |
| JP | 10-225864 | 8/1998 |
| JP | 11-90810 | 4/1999 |

(Continued)

OTHER PUBLICATIONS

Japanese Office Action issued Jul. 3, 2012, in Patent Application No. 2008-023328 (with English-language translation).

(Continued)

*Primary Examiner* — Robert Rose
(74) *Attorney, Agent, or Firm* — Oblon, Spivak, McClelland, Maier & Neustadt, L.L.P.

(57) ABSTRACT

It is an object of the present invention to provide a polishing pad that is resistant to scratching and also has excellent flattening performance. One aspect of the present invention is a polishing pad, comprising a fiber-entangled body formed from fiber bundles made up of ultrafine fibers in which the average cross sectional area is between 0.01 and 30 $\mu m^2$, and a macromolecular elastomer, wherein part of the macromolecular elastomer is present inside the fiber bundles, whereby the ultrafine fibers are bundled, the number of fiber bundles per unit of surface area present in a cross section in the thickness direction is at least 600 bundles per square millimeter, and the volumetric ratio of a portion excluding voids is between 55 and 95%.

20 Claims, 4 Drawing Sheets

(56) References Cited

FOREIGN PATENT DOCUMENTS

| | | |
|---|---|---|
| JP | 11-99479 | 4/1999 |
| JP | 11-322878 | 11/1999 |
| JP | 2000-178374 | 6/2000 |
| JP | 2000-248034 | 9/2000 |
| JP | 2001-1252 | 1/2001 |
| JP | 2001-89548 | 4/2001 |
| JP | 2002-9026 | 1/2002 |
| JP | 2002-28854 | 1/2002 |
| JP | 2002-83790 | 3/2002 |
| JP | 2002-103234 | 4/2002 |
| JP | 2002-155183 | 5/2002 |
| JP | 2002-172555 | 6/2002 |
| JP | 2003-39308 | 2/2003 |
| JP | 2003-170347 | 6/2003 |
| JP | 2003-201676 | 7/2003 |
| JP | 2004-22632 | 1/2004 |
| JP | 2004-507076 | 3/2004 |
| JP | 2004-130395 | 4/2004 |
| JP | 2004-165408 | 6/2004 |
| JP | 2004-299041 | 10/2004 |
| JP | 2004-311731 | 11/2004 |
| JP | 2005-68175 | 3/2005 |
| JP | 2005-74577 | 3/2005 |
| JP | 2005-74609 | 3/2005 |
| JP | 2005-518286 | 6/2005 |
| JP | 2005-212055 | 8/2005 |
| JP | 2005-334997 | 12/2005 |
| JP | 2006-45757 | 2/2006 |
| JP | 2006-114885 | 4/2006 |
| JP | 2007-54910 | 3/2007 |
| JP | 2007-308843 | 11/2007 |
| TW | 200604405 | 2/2006 |
| TW | 200615368 | 5/2006 |

OTHER PUBLICATIONS

International Search Report issued May 13, 2008, in PCT/JP2008/051688.

Masahiro Kashiwagi, et al., "Science of CMP", Science Forum, Inc., Aug. 20, 1997, pp. 113-119.

U.S. Appl. No. 13/058,016, filed Feb. 8, 2011, Nakayama, et al.

Japanese Office Action issued Jul. 31, 2012, in Patent Application No. 2008-023329 (with English-language translation).

Japanese Office Action issued Aug. 7, 2012, in Patent Application No. 2008-023330 (with English-language translation).

Japanese Office Action issued Apr. 2, 2013, in Patent Application No. 2008-023329 (with English-language translation).

Taiwanese Office Action issued on Sep. 6, 2013 in Taiwanese Patent Application No. 097103924 filed Feb. 1, 2008.

POLISHING PAD, AND METHOD FOR MANUFACTURING POLISHING PAD

TECHNICAL FIELD

This invention relates to a polishing pad, and more particularly relates to a polishing pad that is used to polish semiconductor wafers, semiconductor devices, silicon wafers, hard disks, glass substrates, optical products, various metals, and the like, and to a method for manufacturing this pad.

BACKGROUND ART

As integrated circuits have increased in integration and evolved into multilayer wiring in recent years, the semiconductor wafers on which these integrated circuits are formed need to be flat to a high degree of precision.

Chemical-mechanical polishing (CMP) is a known polishing method for polishing semiconductor wafers. CMP involves polishing the surface of a substrate to be polished with a polishing pad while a slurry of abrasive grains is dropped onto the surface.

The following Patent Documents 1 to 4 disclose polishing pads used in CMP, which are composed of a polymer foam having an independent cell structure and being manufactured by foaming a two-part curing type of polyurethane. These polishing pads are stiffer than the nonwoven cloth type of polishing pads described below, and therefore can be used to advantage in the polishing of semiconductor waters, where a high degree of flatness is required.

A polishing pad composed of a polymer foam having an independent cell structure is manufactured, for example, by subjecting a two-part curing type of polyurethane to a cast-foam-molding. Because such a polishing pad has relatively high stiffness, the load tends to be applied during polishing selectively to the convex parts of the substrate being polished, and as a result, the polishing rate is relatively high. However, if agglomerated abrasive grains are present on the polishing surface, the load will also be selectively applied to these agglomerated grains, making the polishing surface more susceptible to scratching. In particular, as described in Non-Patent Document 1, when a substrate having copper wiring that is easily scratched, or a material with a low dielectric constant and low interfacial adhesive strength is polished, scratching or interfacial separation is especially apt to occur. Also, in a cast-foam-molding, it is difficult to foam a macromolecular elastomer uniformly, which means that there tends to cause variance in the flatness of the substrate being polished and in the polishing rate during polishing. Furthermore, with a polishing pad having independent pores, the voids originating in the independent pores can become clogged with abrasive grit and polishing dust. As a result, when the pad is used for an extended period, the polishing rate decreases as polishing proceeds (this feature is also referred to as polishing stability).

Meanwhile, as an another type of a polishing pad, Patent Documents 5 to 14 disclose a nonwoven cloth type of polishing pad, which is obtained by impregnating a polyurethane resin into a nonwoven cloth and by subjecting to wet solidification. These nonwoven cloth polishing pads have superior flexibility, and therefore when agglomerated abrasive grains are present on the polishing surface of the substrate being polished, deformation of the polishing pad will reduce the selective application of load to the agglomerated abrasive grains. However, because the nonwoven cloth polishing pads are flexible, the polishing rate is low. Also, because the polishing pad deforms by conforming to the surface shape of the substrate being polished, high flattening performance (the characteristic of making the polished substrate flat) is not obtained.

In recent years there has come to be known a nonwoven cloth polishing pad that is obtained using a nonwoven cloth formed from ultrafine fiber bundles, the goal of which is to obtain better flattening performance (see the following Patent Documents 15 to 18). More specifically, Patent Document 15, for example, discloses a polishing pad formed in the form of a sheet comprising a nonwoven cloth produced by entangling polyester ultrafine fiber bundles with an average size of 0.0001 to 0.01 dtex, and a macromolecular elastomer whose main component is polyurethane and which is present in the spaces inside this nonwoven cloth. It is stated that this polishing pad affords more precise polishing than in the past.

However, since the polishing pads disclosed in Patent Documents 15 to 18 make use of a nonwoven cloth obtained by needle punching ultrafine staple fibers that are small in size, the apparent density is low and the percentage of void is high. Accordingly, only a polishing pad that is flexible and low in stiffness can be obtained, which means that the pad deforms while conforming to the surface shape, so sufficiently high flattening performance is not obtained.

Patent Document 1: Japanese Patent Application Laid-Open No. 2000-178374

Patent Document 2: Japanese Patent Application Laid-Open No. 2000-248034

Patent Document 3: Japanese Patent Application Laid-Open No. 2001-89548

Patent Document 4: Japanese Patent Application Laid-Open No. H11-322878

Patent Document 5: Japanese Patent Application Laid-Open No. 2002-9026

Patent Document 6: Japanese Patent Application Laid-Open No. H11-99479

Patent Document 7: Japanese Patent Application Laid-Open No. 2005-212055

Patent Document 8: Japanese Patent Application Laid-Open No. H3-234475

Patent Document 9: Japanese Patent Application Laid-Open No. H10-128674

Patent Document 10: Japanese Patent Application Laid-Open No. 2004-311731

Patent Document 11: Japanese Patent Application Laid-Open No. H10-225864

Patent Document 12: Japanese Translation of PCT Application No. 2005-518286

Patent Document 13: Japanese Patent Application Laid-Open No. 2003-201676

Patent Document 14: Japanese Patent Application Laid-Open No. 2005-334997

Patent Document 15: Japanese Patent Application Laid-Open No. 2007-54910

Patent Document 16: Japanese Patent Application Laid-Open No. 2003-170347

Patent Document 17: Japanese Patent Application Laid-Open No. 2004-130395

Patent Document 18: Japanese Patent Application Laid-Open No. 2002-172555

Non-Patent Document 1: Masahiro Kashiwagi et al., "Science of CMP," Science Forum, Inc., Aug. 20, 1997, pp. 113-119

DISCLOSURE OF THE INVENTION

It is an object of the present invention to provide a polishing pad that is resistant to scratching and also has excellent flattening performance.

One aspect of the present invention is a polishing pad, comprising a fiber-entangled body formed from fiber bundles made up of ultrafine fibers in which the average cross sectional area is between 0.01 and 30 $\mu m^2$, and a macromolecular elastomer, wherein part of the macromolecular elastomer is present inside the fiber bundles whereby the ultrafine fibers are bundled, the number of fiber bundles per unit of surface area present in a cross section in the thickness direction is at least 600 bundles per square millimeter, and the volumetric ratio of the portion excluding voids is between 55 and 95%.

The object, characteristics, aspects, and advantages of the present invention will become clear through the following detailed description.

BEST MODE FOR CARRYING OUT THE INVENTION

The present invention will now be described in detail on the basis of embodiments, but the present invention is not limited in any way by the embodiments described below.

Ultrafine fibers are extremely flexible, and therefore polishing pads known in the past and obtained by impregnating a nonwoven cloth composed of ultrafine fibers with a macromolecular elastomer were low in stiffness. The inventors focused on the fact that the bending elasticity of a fiber is proportional to the fourth power of the fiber diameter. They thought that a polishing pad with higher stiffness could be obtained by bundling ultrafine fibers that make up fiber bundles and allowing the fiber bundles to be present in the form of a single thick fiber. When ultrafine fibers are thus bundled and the resulting fiber bundle is in the form of a single thick fiber, this yields a polishing pad having higher stiffness. This also lowers the percentage of void of the polishing pad, which again raises the stiffness of the polishing pad. Further, during polishing, the fiber bundles can become split and fibrillated to form ultrafine fibers of high fiber density on the surface of the polishing pad. The ultrafine fibers thus formed on the surface of the polishing pad increase the contact surface area with the substrate being polished, and also allow the abrasive slurry to raise holding capacity, which results in a higher polishing rate.

The configuration of the polishing pad in the present embodiment, the method for manufacturing and using the polishing pad will now be described through reference to the appended drawings.

Configuration of the Polishing Pad

Figure 1:
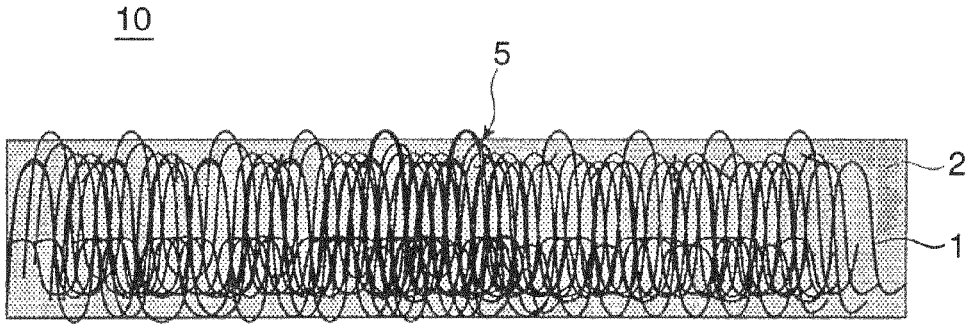
FIG. 1 is an enlarged view of a polishing pad 10 in a present embodiment.
Figure 2:
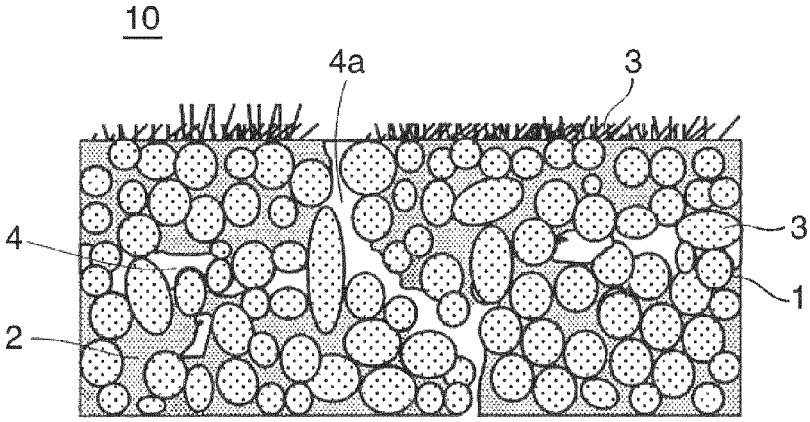
FIG. 2 is a detail enlargement of a cross section in the thickness direction of the polishing pad 10 in a present embodiment.
Figure 3:
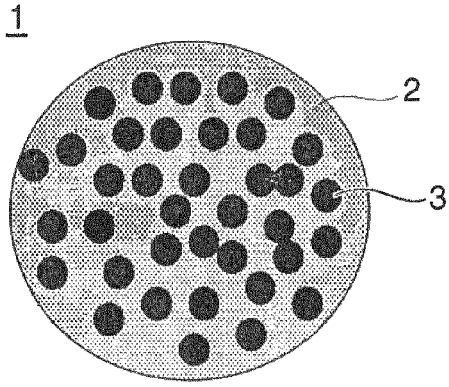
FIG. 3 is a vertical cross section of a fiber bundle produced by bundling ultrafine fibers with a macromolecular elastomer.

FIG. 1 is a schematic of the polishing pad 10 in the present embodiment. FIG. 2 is a detail enlargement of a portion of the polishing pad 10. FIG. 3 is a cross section of a fiber bundle.

In FIGS. 1, 2, and 3, 1 is a fiber bundle formed from ultrafine single fibers, 2 is a macromolecular elastomer, 3 is an ultrafine single fiber, 4 is a void, and 4*a* is a communicating pore formed by a void 4. 5 is a fiber-entangled body formed by fiber bundles 1 composed of the ultrafine fibers 3.

The fiber bundle 1 is formed from a group of the ultrafine fibers 3 having an average cross sectional surface area between 0.01 and 30 $\mu m^2$. As shown in FIG. 3, the ultrafine fibers 3 are bundled together by the macromolecular elastomer 2 present in the internal spaces of the fiber bundle 1. Preferably, a plurality of fiber bundles 1 are bonded together by the macromolecular elastomer 2. The fiber-entangled body 5 is formed by entangling the fiber bundles 1 so that fiber density is high. The density of the fiber bundles 1 in any cross section in the thickness direction is at least 600 bundles per square millimeter. The fiber bundles 1 preferably have a cross sectional area of at least 40 $\mu m^2$. The voids 4 are present in the polishing pad 10 such that the volumetric ratio of the portion excluding voids (hereinafter also referred to as the polishing pad fill ratio) is between 55 and 95%, or in other words, so that the percentage of void is between 5 and 45%. Some of the voids 4 preferably form the communicating pores 4*a*, which afford communication with the interior of the polishing pad 10.

The polishing pad in the embodiment contains a fiber-entangled body composed of fiber bundles of ultrafine fibers, and has a high fiber density and a low percentage of void. Furthermore, the ultrafine fibers that make up the fiber bundles are bundled together by the macromolecular elastomer. With this constitution, the reinforcing effect afforded by the fiber bundles and the reinforcing effect afforded by the high polishing pad fill ratio (that is, the low percentage of void) contribute to providing the polishing pad which maintains high stiffness during polishing. Also, during polishing, the fiber bundles present on the surface of the polishing pad become split and fibrillated, forming ultrafine fibers of high fiber density. These ultrafine fibers increase the contact surface area with the substrate being polished, and a more amount of the abrasive slurry can be held. Furthermore, since the ultrafine fibers expressed during polishing make the surface of the polishing pad softer, if any agglomerated abrasive grains are present, the load that is selectively applied to these agglomerates can be reduced, and this makes it less likely that the substrate being polished will be scratched.

The ultrafine fibers have an average cross sectional area between 0.01 and 30 $\mu m^2$, and preferably between 0.1 and 20 $\mu m^2$. If the average cross sectional area of the ultrafine fibers is less than 0.01 $\mu m^2$, the ultrafine fibers near the surface of the polishing pad will not be sufficiently split up, and as a result, the ability of the pad to hold the abrasive slurry will decrease. On the other hand, if the average cross sectional area of the ultrafine fibers is over 30 $\mu m^2$, the surface of the polishing pad will be too rough, the polishing rate will drop, and abrasive grains will tend to agglomerate on the fiber surface, making it more likely that scratching will occur.

The fiber bundles in the embodiment are formed from ultrafine fibers, and the ultrafine fibers that make up the fiber bundles are bundled together by the macromolecular elastomer.

There are no particular restrictions on the average length of the fiber bundles, but it is preferably at least 100 mm, and more preferably at least 200 mm, because the fiber density of the ultrafine fibers can be raised more easily, because the stiffness of the polishing pad can be raised more easily, and because the fibers will not come loose as readily. If the fiber bundles are too short, it will be difficult to achieve a high density of ultrafine fibers, the stiffness will not be high enough, and there will be a tendency for the ultrafine fibers to fall out readily during polishing. There are no particular restrictions on the upper limit, but when a fiber-entangled body originating in a nonwoven cloth manufactured by spunbond method (described below) is contained, for example, as long as the fibers do not physically break, fibers of several meters, several hundred meters, several kilometers, or even longer may be included.

The fiber bundles in the embodiment preferably have a cross sectional area of at least 40 $\mu m^2$. By using such thick fiber bundles, the stiffness of the polishing pad can be raised. The cross sectional area of a fiber bundle is the total surface area of a cross section composed of the macromolecular elastomer present in the interior of the fiber bundle and the ultrafine fibers that make up the fiber bundle, in a fiber bundle cross section.

The proportion of fiber bundles having a cross sectional area of at least 40 $\mu m^2$ present in a cross section in the thickness direction is preferably at least 25% with respect to the total number of fiber bundles per cross sectional area in a cross section in the thickness direction. With a polishing pad used for a silicon wafer, a semiconductor wafer, or a semiconductor device, which needs to have particularly high flatness, this proportion is preferably at least 40%, and more preferably at least 50%, with 100% being especially good. If the proportion of the above-mentioned fiber bundles having at least 40 $\mu m^2$ is too low, the polishing rate will decrease, or there will be a tendency for the resulting polishing pad not to have adequately high flattening performance.

In terms of obtaining a polishing pad with high enough stiffness, it is preferable for the average cross sectional area of the fiber bundles present in a cross section in the thickness direction to be at least 80 $\mu m^2$, and more preferably at least 100 $\mu m^2$, with at least 120 $\mu m^2$ being particularly good. If the above-mentioned average cross sectional area is too low, it will tend to be harder to maintain an adequately high stiffness.

With the polishing pad of the embodiment, the number of fiber bundles per unit of surface area present in a cross section in the thickness direction is at least 600 bundles per square millimeter. When the fiber bundles are present in such a high density, the ultrafine fibers are formed when the fiber bundles exposed on the surface of the polishing pad become split and fibrillated during polishing, and this improves the capacity to hold the abrasive slurry, affords a soft surface, and prevents the occurrence of scratching.

The fiber bundle density is preferably such that the number of fiber bundles per unit of surface area present in a cross section in the thickness direction is at least 600 bundles per square millimeter, and more preferably at least 1000 bundles per square millimeter, and preferably no more than 4000 bundles per square millimeter, and more preferably no more than 3000 bundles per square millimeter. If the bundle density is less than 600 bundles per square millimeter, the density of ultrafine fibers formed on the polishing pad surface will be lower, the polishing rate will decrease, and flattening performance will suffer. If the bundle density is too high, the polishing pad surface will be too solid and not able to hold enough of the abrasive grains, so there will be a tendency for the polishing rate to decrease. With the polishing pad of the embodiment, in terms of polishing stability, it is preferable for the fiber density of fiber bundles to be homogeneous in the planar direction and the thickness direction.

The fiber-entangled body in the embodiment is the product of entangling the fiber bundles, and is higher in density than an ordinary nonwoven cloth. More specifically, the fiber-entangled body is preferably such that the volumetric ratio of the portion excluding voids (hereinafter also referred to as the fiber-entangled body fill ratio) is at least 35%, and more preferably at least 50%, and preferably no more than 90%, and more preferably no more than 80%. If the above-mentioned fiber-entangled body fill ratio is too low, the surface of the fiber-entangled body will be rough, so the surface of the resulting polishing pad will be too rough, flattening performance will tend to decrease, and there will be tendency for the fiber density of the polishing pad surface to be low. On the other hand, if the fiber-entangled body fill ratio is too high, the fiber-entangled body will be too solid and it will be difficult for the interior of the fiber bundles to be sufficiently impregnated with the macromolecular elastomer. As a result, the ultrafine fibers will not be adequately bundled, the fibers will come loose, and there will be a tendency for polishing stability to decrease, or for the abrasive grains to concentrate on fibers that have fallen out.

Specific examples of the ultrafine fibers that make up the polishing pad in the embodiment include aromatic polyester fibers formed from polyethylene terephthalate (PET), isophthalic acid-modified polyethylene terephthalate, sulfoisophthalic acid-modified polyethylene terephthalate, polybutylene terephthalate, polyhexamethylene terephthalate, or the like; aliphatic polyester fibers formed from polylactic acid, polyethylene succinate, polybutylene succinate, polybutylene succinate adipate, polyhydroxybutyrate-polyhydroxyvalerate copolymer, or the like; polyamide fibers formed from polyamide 6, polyamide 66, polyamide 10, polyamide 11, polyamide 12, polyamide 6-12, or the like; polyolefin fibers formed from polypropylene, polyethylene, polybutene, polymethylpentene, chlorinated polyolefins, or the like; modified polyvinyl alcohol fibers formed from modified polyvinyl alcohols containing 25 to 70 mol % ethylene units, or the like; and elastomer fibers formed from polyurethane elastomers, polyamide elastomers, polyester elastomers, and other such elastomers. These can be used singly or in combinations of two or more.

Of the above-mentioned ultrafine fibers, a particularly favorable fiber is one composed of a thermoplastic resin whose glass transition temperature (Tg) is at least 50° C., and preferably at least 60° C., and whose water absorbency is no more than 4 mass %, and preferably no more than 2 mass %.

If the glass transition temperature of the thermoplastic resin is within the above range, higher stiffness can be maintained, so the flattening performance will be even better, and during polishing there will be no decrease in stiffness over time, so the polishing pad can be obtained with superior polishing stability and polishing uniformity. There are no particular restrictions on the upper limit to the glass transition temperature, but for industrial manufacturing purposes, 300° C. or lower is preferable, and 150° C. or lower is even better.

If the water absorbency of the thermoplastic resin is 4 mass % or less, then the polishing pad will not absorb too much abrasive slurry during polishing, which further reduces the decrease in stiffness over time. In this case, the decrease in flattening performance over time is minimized, and the polishing pad is obtained with which the polishing rate and polishing uniformity fluctuate less. Specific examples of such thermoplastic resins include aromatic polyester fibers formed from polyethylene terephthalate (PET, Tg 77° C., water absorbency 1 mass %), isophthalic acid-modified polyethylene terephthalate (Tg 67 to 77° C., water absorbency 1 mass %), sulfoisophthalic acid-modified polyethylene terephthalate (Tg 67 to 77° C., water absorbency 1 to 4 mass %), polybutylene naphthalate (Tg 85° C., water absorbency 1 mass %), polyethylene naphthalate (Tg 124° C., water absorbency 1 mass %), or the like; and semi-aromatic polyamide fibers formed from a copolymer polyamide of terephthalic acid, nonanediol, and methyloctanediol (Tg 125 to 140° C., water absorbency 1 to 4 mass %), or the like. In particular, PET or a modified PET, such as isophthalic acid-modified PET, is preferable in that the fiber-entangled body being solid and having high density can be formed because of the large amount of crimping in a wet heat treatment for forming ultrafine fibers from a web entangled sheet composed of islands-in-the-sea type composite fibers (described below), in that the stiffness of the polishing sheet can be easily raised, in that moisture is unlikely to cause changes over time during polishing, and so forth.

The polishing pad in the embodiment has a structure in which a macromolecular elastomer is filled in and compounded with the above-mentioned fiber-entangled body.

Specific examples of the macromolecular elastomer used in the embodiment include elastomers composed of polyurethane resin, polyamide resin, (meth)acrylic acid ester resin, (meth)acrylic acid ester-styrene resin, (meth)acrylic acid ester-acrylonitrile resin, (meth)acrylic acid ester-olefin resin, (meth)acrylic acid ester-(hydrogenated) isoprene resin, (meth)acrylic acid ester-butadiene resin, styrene-butadiene resin, styrene-hydrogenated isoprene resin, acrylonitrile-butadiene resin, acrylonitrile-butadiene-styrene resin, vinyl acetate resin, (meth)acrylic acid ester-vinyl acetate resin, ethylene-vinyl acetate resin, ethylene-olefin resin, silicone resin, fluororesin, polyester resin, or the like.

Water absorbency of the macromolecular elastomer is preferably 0.5 to 8 mass % , and more preferably 1 to 6 mass %. If the water absorbency of the macromolecular elastomer is within this range, the wettability of the polishing pad with respect to the abrasive slurry during polishing will be kept high, and the decrease in stiffness over time will be further reduced. Consequently, the polishing rate, the polishing uniformity, and the polishing stability can be maintained. The "water absorbency of the macromolecular elastomer" is the water absorbency when a macromolecular elastomer film that has undergone drying treatment is immersed in room temperature water and allowed to swell to saturation. When two or more types of macromolecular elastomer are contained, this may also be theoretically calculated as the sum of the products of multiplying the mass ratio by the water absorbency of each macromolecular elastomer.

The macromolecular elastomer having such water absorbency can be obtained, for example, by introducing a hydrophilic functional group, or adjusting the crosslinking density of the macromolecule that makes up the macromolecular elastomer.

More specifically, the water absorbency and hydrophilic property can be adjusted by introducing into the macromolecular elastomer at least one kind of hydrophilic group selected from the group consisting of a carboxyl group, a sulfonic acid group, and a polyalkylene glycol group having a carbon number of 3 or less. This improves the wettability of the polishing pad with respect to the abrasive slurry during polishing.

The hydrophilic group can be introduced into the macromolecular elastomer by copolymerizing a monomer component having the hydrophilic group as the monomer component in manufacturing the macromolecular elastomer. The proportion in which the monomer component having the hydrophilic group is copolymerized is preferably from 0.1 to 20 mass %, and more preferably 0.5 to 10 mass %, because swelling and softening caused by water absorption can be kept to a minimum while water absorbency and wettability can be improved.

The single macromolecular elastomer may be used, or two or more types may be combined. Of these, the polyurethane resin has superior adhesion for bundling the ultrafine fibers or binding the fiber bundles together, and is also preferable in terms of raising the hardness of the polishing pad and affording superior polishing stability over time. The polyurethane resin having at least one kind of hydrophilic group selected from the group consisting of a carboxyl group, a sulfonic acid group, and a polyalkylene glycol group having a carbon number of 3 or less is preferable in terms of the stiffness, wettability, and polishing stability over time of the polishing pad.

A storage elastic modulus of the macromolecular elastomer at 150° C., "E' (150° C., dry)", is preferably between 0.1 and 100 MPa, and more preferably between 1 and 80 MPa. The macromolecular elastomer having such elastic modulus can be obtained by forming a crosslinked structure in the macromolecular elastomer. In general, when a macromolecular elastomer has a hydrophilic group, there is a tendency for the elastomer to be swelled by water and for its water absorbency to be too high. In such a case, the water absorbency can be controlled by adjusting the crosslinking density. If two or more kinds of the macromolecular elastomer are contained, the "E' (150° C., dry)" of the macromolecular elastomer is theoretically calculated as the sum of the products of multiplying the mass ratio by the "E' (150° C., dry)" of each macromolecular elastomer.

With the polishing pad of the present embodiment, the volumetric ratio of the portion excluding voids (the polishing pad fill ratio) is higher (that is, the percentage of void is lower) than with a conventional nonwoven cloth type of polishing pad.

More specifically, the polishing pad fill ratio is from 55 to 95%, and preferably 60 to 90%. If the polishing pad fill ratio is less than 55%, the surface will be too rough, the polishing rate will decrease, and flattening performance will also suffer. Also, the hardness will vary during polishing, so polishing stability will decrease. On the other hand, if the polishing pad fill ratio is over 95%, the pad will not be able to hold as much abrasive slurry, and the polishing rate will decrease. Also, the stiffness of the polishing pad will be too high, so the pad will not be able to conform as well to warping or undulations in the surface of the substrate being polished, and as a result there will be more scratching, or the flatness of the entire surface of the substrate being polished (the global flatness) will decrease. To find the polishing pad fill ratio, the apparent density of the polishing pad is found, while the density when the percentage of void is zero (theoretical density) is calculated from the constitutional ratios of the various materials constituting the polishing pad and the densities thereof, and the equation "apparent density of polishing pad/theoretical density×100(%)" is used to calculate the polishing pad fill ratio.

With the polishing pad of the embodiment, the ultrafine fibers that form the fiber bundles are bundled together by the macromolecular elastomer. Thus, bundling the ultrafine fibers increases the stiffness of the polishing pad. If the ultrafine fibers are not bundled, high flattening performance will not be obtained because of the flexibility of the ultrafine fibers. Also, more of the fibers will come loose, abrasive grains will tend to concentrate on the loose fibers, and this will tend to result in more scratching. The phrase "the ultrafine fibers are bundled" here means a state in which the majority of the ultrafine fibers present in the fiber bundles are bonded and restrained by the macromolecular elastomer present inside the fiber bundles.

It is preferable if a plurality of fiber bundles are affixed by the macromolecular elastomer present on the outside of the fiber bundles, and are present in a bulk state. Having the fiber bundles be affixed in this way increases the stability of the polishing pad configuration and improves polishing stability.

The bundled state of the ultrafine fibers and the affixed state of the fiber bundles can be confirmed from an electron micrograph of a cross section of the polishing pad.

The macromolecular elastomer that bundles the ultrafine fibers, and the macromolecular elastomer that affixes the fiber bundles are preferably in a non-porous form. "Non-porous form" here means a state in which there are substantially no voids (independent cells) as would be present in a macromolecular elastomer that was porous or sponge-like (hereinafter also referred to as simply "porous"). More specifically, for example, this means that it is not a macromolecular elastomer having numerous fine cells as would be obtained by solidifying a solvent-based polyurethane. When a macromolecular elastomer for bundling or affixing is non-porous, the polishing stability is higher, and slurry debris or pad debris is less likely to accumulate in the voids during polishing, so there is less abrasion, and since slurry debris or pad debris is less likely to accumulate in the voids during polishing, the polishing rate can be kept high for a longer period. Furthermore, since the adhesive strength with respect to the ultrafine fibers is higher, there is less occurrence of the scratching that would be attributable to fibers that come loose. And since higher stiffness is obtained, the polishing pad with superior flattening performance is obtained.

The ratio between the fiber-entangled body and the macromolecular elastomer in the polishing pad of the embodiment is preferably between 90/10 and 55/45, and more preferably between 85/15 and 65/35, as a mass ratio. If the mass ratio of the fiber-entangled body and the macromolecular elastomer is within the above range, the fiber bundle will tend to have a large cross sectional area, and the density of the ultrafine single fibers exposed on the polishing pad surface can be raised sufficiently. As a result, the polishing stability, polishing rate, and flattening performance can be further improved. If the above ratio is too high, it will be difficult for the macromolecular elastomer to thoroughly fill the interior of the fiber bundles, but if it is too low, the fiber density will tend to be inadequate.

Also, with the polishing pad of the embodiment, the storage elastic modulus at 50° C., "E' (50° C., dry)", is preferably between 100 and 800 MPa, and more preferably between 200 and 600 MPa. In polishing by CMP, as the polishing proceeds, there is a tendency for frictional heat to raise the temperature of the polishing pad up to about 50° C. Therefore, if the storage elastic modulus of the polishing pad at 50° C. is too low, the stiffness of the polishing pad will end up decreasing as the polishing proceeds. As a result, there is a tendency for the polishing rate and the flatness of the substrate being polished to decrease. Also, if the above-mentioned storage elastic modulus of the polishing pad is too high, there will be a tendency for the stiffness to be too high during polishing, causing more scratching.

The polishing pad in the embodiment preferably has a water absorbency upon swelling to saturation with 50° C. hot water of between 5 and 45 mass %, and more preferably between 10 and 30 mass %. If the water absorbency is too low, the pad will not be able to hold as much abrasive slurry, so there will be a tendency for the polishing rate to decrease and flattening performance to suffer. If the water absorbency is too high, a high polishing rate will not be attained, and the hardness and other such characteristics will vary during polishing, so there tends to be a decrease in flattening performance over time.

The polishing pad in the embodiment preferably has communicating pores, which makes it easier to adjust the water absorbency. With just an independent cell structure, the polishing pad will not absorb water as well, making it difficult to achieve the water absorbency of 5 to 45 mass. The term "communicating pores" here means pores that pass through the surface and back sides of the polishing pad.

Because the water absorbency in the communicating pore structure is correlated to the voids in the polishing pad, the water absorbency can be adjusted by adjusting the proportion of voids in the polishing pad. The presence of the communicating pores can be confirmed by the fact that water dropped onto the surface side of the polishing pad goes through the communicating pores in the pad and comes out on the back side.

More specifically, it is preferable that, in a Byreck water absorbency test as set forth in JIS L 1907-1994, the water absorption height after 60 minutes is at least 5 mm, and preferably at least 10 mm, since it will result in the good wettability of the polishing pad with respect to the slurry during polishing, and as a result a higher polishing rate will be obtained and the polishing uniformity and polishing stability will be improved. To obtain such good permeability, for example, it is preferable that the high-density ultrafine fibers are present on the polishing pad surface, the macromolecular elastomer which has a hydrophilic group and water absorbency of at least 0.5 mass % is used, and there are the communicating pores in the interior of the polishing pad.

As to the extent to which the communicating pores are present, it is preferable that, in a wicking water absorbency test as set forth in JIS L 1907-1994, the rate of absorption of 40 mg of water is about 0.1 seconds to 10 minutes.

Also, with the polishing pad in the embodiment, the storage elastic modulus at 50° C. upon swelling to saturation with 50° C. hot water, "E' (50° C., wet)", is preferably between 100 and 800 MPa, and more preferably between 200 and 600 MPa. In polishing by CMP, as the polishing proceeds, there is a tendency for frictional heat to raise the temperature of the polishing pad up to about 50° C. Also, the polishing is carried out in a wet state in the presence of an abrasive slurry. If the storage elastic modulus of the polishing pad at 50° C. upon swelling to saturation with 50° C. hot water is less than 100 MPa, the stiffness of the polishing pad will decrease as the polishing proceeds. As a result, there is a tendency for the polishing rate and the flatness of the substrate being polished to decrease. Also, if the storage elastic modulus of the polishing pad, "E' (50° C., wet)", is over 800 MPa, the stiffness will be too high during polishing, causing more scratching.

With the polishing pad in the embodiment, the loss elastic modulus at 50° C. upon swelling to saturation with 50° C. hot water, "E" (50° C., wet)", is preferably between 13 and 130 MPa, and more preferably between 30 and 100 MPa. If the loss elastic modulus, "E" (50° C., wet)", is too low, plastic deformation (permanent deformation) during polishing will change the shape of the polishing pad, and there will be a tendency for the polishing rate to decrease over time. On the other hand, if the loss elastic modulus, "E" (50° C., wet)", is too high, the polishing pad will be so resistant to plastic deformation that its flexibility (cushioning) will decrease, which in turn decreases a property how well the pad fits against the substrate being polished, so there is a tendency for the flattening performance to suffer.

Further, with the polishing pad in the embodiment, the ratio between the storage elastic modulus at 50° C., "E' (50° C., dry)", and the storage elastic modulus at 50° C. upon swelling to saturation with 50° C. hot water, "E' (50° C., wet)", that is "E' (50° C., dry)"/"E' (50° C., wet)", is preferably 2.5 or less, and more preferably 1.8 or less, and preferably at least 0.5. If the ratio, "E' (50° C., dry)"/"E' (50° C., wet)", is over 2.5, there will be a tendency for the stiffness to decrease, which means that the polishing rate and polishing uniformity will fluctuate, and consequently there will be a tendency for the polishing stability to decrease.

Also, with the polishing pad in the embodiment, the ratio between the storage elastic modulus at 23° C. upon swelling to saturation with 50° C. hot water, "E' (23° C., wet)", and the storage elastic modulus at 50° C. upon swelling to saturation with 50° C. hot water, "E' (50° C., wet)", that is "E' (23° C., wet)"/"E' (50° C., wet)", is preferably 2.5 or less, and more preferably 1.8 or less, and preferably at least 0.5. The surface of the polishing pad during polishing may vary up to about 23 to 50° C., either locally or entirely. In such a case, if the ratio, "E' (23° C., wet)"/"E' (50° C., wet)", is over 2.5, there will be a tendency for the temperature to rise locally during polishing, causing a partial decrease in the stiffness of the polishing pad. Consequently, there will be a tendency for the polishing rate and polishing uniformity to fluctuate and for polishing stability to decrease. For example, the storage elastic modulus of a polyurethane elastomer has a high temperature dependency, and this temperature dependency varies with water absorption, but in general, a polyurethane elastomer has a large ratio of "E' (23° C., wet)"/"E' (50° C., wet)" (about 2.5 to 20, for example). With the polishing pad in the embodiment, the ratio of E' (23° C., wet)/"E' (50° C., wet)" in the polishing pad can be lowered by filling to a high ratio with the ultrafine single fibers, for example, composed of the thermoplastic resin whose glass transition temperature is at least 50° C. and whose water absorbency is no more than 4 mass %.

The apparent density of the polishing pad in the embodiment is preferably from 0.7 to 1.2 g/cm$^2$, and more preferably 0.8 to 1.2 g/cm$^2$, because stiffness will be superior.

The JIS-D hardness at 23° C. of the polishing pad in the embodiment, "D (23° C., dry)", is preferably from 45 to 75, and more preferably about 50 to 70. If the D hardness, "D (23° C., dry)", is too high, scratching will be more prone to occur, but if it is too low, there will be a tendency for flattening performance to decrease. Since the polishing pad in the embodiment is formed such that the ultrafine fibers on the surface have a high fiber density, the surface is softer than with a polishing pad not containing ultrafine fibers. Accordingly, scratching will be unlikely to occur even if the D hardness is raised.

Furthermore, with the polishing pad in the embodiment, the D hardness at 23° C. upon swelling to saturation with 50° C. hot water, "D (23° C., wet)", is preferably from 50 to 70. The value of D (23° C., wet) of 50 to 70 is obtained with the polishing pad in which "E' (50° C., wet)" is about 130 to 800 MPa.

The ratio of the D hardness of the polishing pad at 23° C. upon swelling to saturation with 50° C. hot water, "D (23° C., wet)", to the D hardness of the polishing pad at 23° C., "D (23° C., dry)", that is "D (23° C., wet)"/"D (23° C., dry)", is preferably about 0.9 to 1.1. The polishing pad with the above-mentioned ratio of 0.9 or greater is obtained when the ratio of "E' (50° C., dry)"/"E' (50° C., wet)" is no more than about 2.5.

If the D hardness of the polishing pad at 23° C. upon swelling to saturation with 50° C. hot water, "D (23° C., wet)", is 47 to 70, this substantially corresponds to the C hardness upon swelling to saturation with 50° C. hot water, "C (23° C., wet)", of about 92 to 99, and to the A hardness upon swelling to saturation with 50° C. hot water, "A (23° C., wet)", of about 91 to 99.

Also, with the polishing pad in the embodiment, the amount of abrasion loss in taber abrasion test (abrasion wheel H-22, load of 500 g, 1000 times) is preferably 10 to 150 mg, and more preferably 20 to 100 mg. If the abrasion loss is too small, the surface structure will not readily be renewed in itself in dressing treatment, etc., during polishing, making clogging more apt to occur, which decreases the polishing rate and shortens the service life of the polishing pad. On the other hand, if the abrasion loss is too large, the fibers will readily come loose, which means that polishing stability will decrease, or scratching will be more likely to be caused by fibers that fall out. The service life of the polishing pad is also shortened. With the polishing pad in the embodiment, the abrasion loss can be suitably adjusted by adjusting the ratio between the macromolecular elastomer and the fiber-entangled body composed of fiber bundles of ultrafine fibers that are bundled at a high fiber density and are resistant to abrasion.

With the polishing pad in the embodiment, the ultrafine fibers can be formed on the surface of the polishing pad by separating or fibrillating the fiber bundles present near the surface by subjecting the pad to a flattening treatment by buffing or the like, or to a seasoning treatment (conditioning treatment) prior to polishing with diamond or another such hard dressing, or to a dressing treatment during polishing. The fiber density of the ultrafine fibers on the surface of the polishing pad is preferably at least 600 fibers per square millimeter, and more preferably at least 1000 fibers per square millimeter, with at least 2000 fibers per square millimeter being particularly good. If the fiber density is too low, there will be a tendency for the pad not to hold enough of the abrasive grains. There are no particular restrictions on the upper limit to the fiber density, but from the standpoint of productivity, it is about 1000000 fibers per square millimeter. The ultrafine fibers on the surface of the polishing pad may or may not be raised. If the ultrafine fibers are raised, the polishing pad surface will become softer, which further enhances the effect to reduce scratching. On the other hand, if the degree of raised ultrafine fibers is low, this can be advantageous in applications where micro-flatness is a priority. The surface condition is preferably selected as dictated by the intended application.

Method for Manufacturing the Polishing Pad

One example of the method for manufacturing the polishing pad in the present embodiment will now be described in detail.

The polishing pad in the embodiment can be obtained by a manufacturing method comprising a web manufacturing step of manufacturing a long fiber web composed of islands-in-the-sea type composite fibers obtained by the melt spinning of a water-soluble thermoplastic resin and a water-insoluble thermoplastic resin, a web entanglement step of forming a web entangled sheet by lapping a plurality of the long fiber webs and entangling them, a wet heat shrinkage treatment step of subjecting the web entangled sheet to wet heat shrinkage so that the surface area shrinkage ratio is at least 35%, a fiber-entangled body formation step of forming a fiber-entangled body composed of ultrafine fibers by dissolving the water-soluble thermoplastic resin in the web entangled sheet in hot water, and a macromolecular elastomer filling step of impregnating the fiber-entangled body with an aqueous solution of a macromolecular elastomer and then drying and solidifying.

In the above-mentioned manufacturing method, when the step of subjecting the web entangled sheet containing long fibers to wet heat shrinkage is included, the web entangled sheet can be shrunken more than in a case where a web entangled sheet containing short fibers is subjected to wet heat shrinkage, which results in a higher fiber density of the ultrafine fibers. When the water-soluble thermoplastic resin in the web entangled sheet is dissolved and extracted, this forms the fiber-entangled body composed of the ultrafine fiber bundles. Voids are formed here in the portions where the water-soluble thermoplastic resin is dissolved and extracted. These voids are impregnated with the aqueous solution of the macromolecular elastomer, which is dried and solidified to bundle the ultrafine fibers that make up the ultrafine fiber bundles, and also to bundle the ultrafine fiber bundles themselves. This gives the stiff polishing pad in which the fiber density is high, percentage of the voids is low, and the ultrafine fibers are bound together.

The various steps will now be described in detail.

(1) Web Manufacturing Step

In this step, first a long fiber web composed of islands-in-the-sea type composite fibers is manufactured by subjecting a water-soluble thermoplastic resin and a water-insoluble thermoplastic resin to melt spinning.

The islands-in-the-sea composite fibers are obtained by subjecting a water-soluble thermoplastic resin and a water-insoluble thermoplastic resin that has low miscibility with the water-soluble thermoplastic resin to melt spinning, and then compounding. The water-soluble thermoplastic resin is dissolved and removed, or decomposed and removed, from the islands-in-the-sea composite fibers, which forms ultrafine fibers. For industrial purposes, the thickness of the islands-in-the-sea composite fibers is preferably 0.5 to 3 decitex.

Furthermore, in the embodiment, the islands-in-the-sea composite fibers are described in detail as the composite fibers used to form the ultrafine fibers, but any known types of fiber generating ultrafine fiber, such as multilayer laminate cross section fiber, may be used in place of the islands-in-the-sea composite fiber.

As the water-soluble thermoplastic resin, a thermoplastic resin that can be dissolved away or decomposed away with water, an alkaline aqueous solution, an acidic aqueous solution, or the like, and that can be used in melt spinning can be used favorably. Specific examples of such water-soluble thermoplastic resins include polyvinyl alcohol, polyvinyl alcohol copolymers, and other such polyvinyl alcohol resins (PVA resins); modified polyesters containing a polyethylene glycol and/or sulfonic acid alkali metal salt as a copolymerization component; and polyethylene oxide. Of these, PVA resins can be preferably used for the reasons below.

When the islands-in-the-sea composite fibers are used in which the PVA resin serves as the water-soluble thermoplastic resin, the ultrafine fibers that are formed will be greatly crimped by dissolving the PVA resin. This gives the fiber-entangled body with a high fiber density. And when the islands-in-the-sea composite fibers are used in which the PVA resin serves as the water-soluble thermoplastic resin, the ultrafine fibers that are formed and the macromolecular elastomer will not be substantially dissolved or decomposed when the PVA resin is dissolved, so it is less likely that the properties of the ultrafine fibers or macromolecular elastomer will be adversely affected. Furthermore, there is less impact on the environment.

The PVA resin is obtained by saponifying a copolymer whose main component is vinyl ester units. Specific examples of the vinyl units used to form the vinyl ester units include vinyl acetate, vinyl formate, vinyl propionate, vinyl valerate, vinyl caprate, vinyl laurate, vinyl stearate, vinyl benzoate, vinyl pivalate, and vinyl versatate. These may be used singly, or two or more types may be combined. Of these, vinyl acetate is preferable for industrial purposes.

The PVA resin may be a homo-PVA composed of vinyl ester units alone, or a modified PVA that contains copolymerization monomer units other than vinyl ester units as its constituent units. From the standpoint of controlling melt spinnability, water solubility, and fiber properties, the modified PVA is preferred. Specific examples of copolymerization monomer units other than vinyl ester units include ethylene, propylene, 1-butene, isobutene, and other $C_4$ and lower alpha-olefins; and methyl vinyl ether, ethyl vinyl ether, n-propyl vinyl ether, isopropyl vinyl ether, n-butyl vinyl ether, and other such vinyl ethers. The proportion in which the copolymerization monomer units other than vinyl ester units are contained is preferably from 1 to 20 mol %, and more preferably 4 to 15 mol %, and even more preferably 6 to 13 mol %. Of these, an ethylene-modified PVA containing the ethylene units in 4 to 15 mol %, and preferably 6 to 13 mol % is preferable in that the properties of the islands-in-the-sea composite fibers will be better.

The viscosity average degree of polymerization of the PVA resin is preferably 200 to 500, and more preferably 230 to 470, with 250 to 450 being particularly good, in terms of forming a staple islands-in-the-sea structure, exhibiting a melt viscosity with excellent melt spinnability, and achieving fast dissolution. The above-mentioned degree of polymerization is measured as set forth in JIS K 6726. That is, the PVA resin is re-saponified and purified, after which the degree is found using the following equation from the intrinsic viscosity ($\eta$) measured in 30° C. water.

Viscosity average degree of polymerization $P=(\eta\times103/8.29)(1/0.62)$

The degree of saponification of the PVA resin is preferably 90 to 99.99 mol %, and more preferably 93 to 99.98 mol %, and even more preferably 94 to 99.97 mol %, with 96 to 99.96 being especially good. If the degree of saponification is within the above range, the PVA resin will be obtained with excellent water solubility, good thermal stability, excellent melt spinnability, and even excellent biodegradability.

The melting point of the PVA resin is preferably 160 to 250° C., and more preferably 170 to 227° C., still more preferably 175 to 224° C., and even more preferably 180 to 220° C. being especially good, in terms of excellent mechanical properties and thermal stability, and excellent melt spinnability. If the melting point of the PVA resin is too high, the melting point will be too close to a decomposition temperature, so decomposition will occur during melt spinning, and there will be a tendency for melt spinnability to suffer.

It is undesirable for the melting point of the PVA resin to be too low compared to the melting point of the water-insoluble thermoplastic resin because melt spinnability will decrease. From this standpoint, it is preferable that the melting point of the PVA resin is not too low by 60° C. or more, more preferably by 30° C. or more, in comparison with the melting point of the water-insoluble thermoplastic resin.

The thermoplastic resin that can be dissolved away or decomposed away with water, an alkaline aqueous solution, an acidic aqueous solution, or the like, and that can be used in melt spinning can be used favorably as the above-mentioned water-insoluble thermoplastic resin.

Specific examples of such water-insoluble thermoplastic resins include the above-mentioned various thermoplastic resins used to form the ultrafine fibers that make up the polishing pad.

The water-insoluble thermoplastic resin may also contain various additives. Specific examples of these additives include catalysts, coloration inhibitors, heat resistant agents, flame retardants, lubricants, anti-fouling agents, fluorescent whiteners, delustering agents, colorants, gloss improvers, antistatic agents, aromatics, deodorants, anti-fungal agents, miticides, and inorganic microparticles.

Next, the method for melt spinning the above-mentioned water-soluble thermoplastic resin and the above-mentioned water-insoluble thermoplastic resin to form the islands-in-the-sea composite fibers and form the long fiber web from the islands-in-the-sea composite fibers thus obtained will be described in detail.

The long fiber web is obtained, for example, by compounding the above-mentioned water-soluble thermoplastic resin and the above-mentioned water-insoluble thermoplastic resin by melt spinning, and then by drawing and depositing using a spun-bond method. Thus, forming the web by the spun-bond method gives the long fiber web composed of the islands-in-the-sea composite fibers that have good form stability, high fiber density, and few fibers that come loose. The "long fiber" here is a fiber manufactured without going through a cutting step, as is the case in the manufacture of a short fiber.

In the manufacture of the islands-in-the-sea composite fibers, the water-soluble thermoplastic resin and the water-insoluble thermoplastic resin are each melt spun and then compounded. The mass ratio of the water-soluble thermoplastic resin and the water-insoluble thermoplastic resin is preferably between 5/95 and 50/50, and more preferably between 10/90 and 40/60. If the mass ratio of the water-soluble thermoplastic resin and the water-insoluble thermoplastic resin is within this range, the fiber-entangled body having high density can be obtained, and the ultrafine fibers can be favorably formed.

After the water-soluble thermoplastic resin and the water-insoluble thermoplastic resin have been compounded by melt spinning, the long fiber web is formed by the spun-bond method, which will now be described in detail.

First, the water-soluble thermoplastic resin and the water-insoluble thermoplastic resin are each melt kneaded in separate extruders, and strands of molten resin are simultaneously discharged from different spinnerets. The discharge strands are compounded in a compounding nozzle, after which this is discharged from the nozzle holes in a spinning head, which forms the islands-in-the-sea composite fibers. In melt compound spinning, the number of islands in the islands-in-the-sea composite fibers is preferably from 4 to 4000 islands per fiber, and more preferably 10 to 1000 islands per fiber, because the single fiber size will be smaller and the fiber bundles with higher fiber density will be obtained.

After the islands-in-the-sea composite fibers have been cooled with a cooling apparatus, an air jet nozzle or other such suction apparatus is used to draw the fibers with a high-speed air flow moving at a speed equivalent to a take-up speed of 1000 to 6000 meters per minute so as to attain the targeted fiber size. Then, the long fiber web is formed by depositing the drawn composite fibers on a moving trap surface. Here, the deposited long fiber web may be partially compressed if needed. The basis weight of the fiber web is preferably between 20 and 500 g/m$^2$ because a more uniform fiber-entangled body will be obtained and because this is preferable for industrial purposes.

(2) Web Entanglement Step

Next, the web entanglement step in which the web entangled sheet is formed by lapping a plurality of the resulting long fiber webs and entangling them will be described.

The web entangled sheet is formed by performing an entanglement treatment on the long fiber web, using a known nonwoven cloth manufacturing method such as needle punching or high-pressure water jetting. The entanglement by the needle punching will be described in detail below as a typical example.

First, a mineral oil-based oil or a silicone-based oil, such as an oil to prevent needle breakage, an antistatic oil, or a entangling oil, is applied to the long fiber web. To reduce basis weight variance, two or more fiber webs may be placed over one another by cross lapper, and the oil may be applied.

Then, for example, entangling is performed in which the fibers are entangled three-dimensionally by needle punching. Performing the needle punching raises the fiber density and gives the web entangled sheet from which the fibers are less likely to fall out. The basis weight of the web entangled sheet is suitably selected according to the thickness of the targeted polishing pad and so forth, and more specifically, it is preferably between 100 and 1500 g/m$^2$ because handling will be easier.

The type and amount of the oil, the shape of the needle used in the needle punching, the needle depth, the number of punches, and other such needle conditions are suitably selected so that the interlayer separation strength of the web entangled sheet will be high. The number of barbs is preferably higher within the extent that needle breakage does not occur, and more specifically is selected from among one to nine barbs, for example. The needle depth is preferably set such that the barbs will go all the way through to the lapped web surface, and such that the pattern after the needle punching will not stand out clearly on the web surface. The number of needle punches is adjusted by means of the needle shape, the type and amount of the oil used, and so forth, but more specifically it is preferably from 500 to 5000 punches per square centimeter. The basis weight after entangling, as a mass ratio of the basis weight prior to entangling, is preferably at least 1.2 times, and more preferably at least 1.5 times, because the fiber-entangled body with higher fiber density will be obtained, and because fewer fibers will come loose. There are no particular restrictions on the upper limit, but four times or lower is preferable in terms of avoiding an increase in a manufacturing cost due to a reduced treatment speed.

The interlayer separation strength of the web entangled sheet is preferably at least 2 kg/2.5 cm, and more preferably at least 4 kg/2.5 cm, because the sheet will hold its shape better, fewer fibers will come loose, and the fiber-entangled body with higher fiber density will be obtained. The interlayer separation strength is also a measure of the degree of three-dimensional entanglement. If the interlayer separation strength is too low, the fiber-entangled body will not have high enough fiber density. There are no particular restrictions on the upper limit of the interlayer separation strength of the entangled nonwoven cloth, but in terms of entanglement treatment efficiency, 30 kg/2.5 cm or less is preferable.

For the purpose of adjusting the hardness of the polishing pad, and to the extent that the effect of the present invention is not compromised, if needed, a knit or woven fabric (textile) may be placed over the web entangled sheet, a nonwoven cloth, obtained as above, and the resulting laminate structure in which the textile is entangled and integrated with the entangled nonwoven cloth by performing entangling through needle punching or high-pressure water jetting, such as a textile/entangled nonwoven cloth, or a entangled nonwoven cloth/textile/entangled nonwoven cloth, may be used as the web entangled sheet.

There are no particular restrictions on the ultrafine fibers that make up the textile. More specifically, though, favorable examples include polyester fibers formed from polyethylene terephthalate (PET), polytrimethylene terephthalate, polybutylene terephthalate (PBT), a polyester elastomer, or the like; polyamide fibers formed from polyamide 6, polyamide 66, aromatic polyamide, polyamide elastomers or the like; and fibers composed of a urethane polymer, an olefin polymer, an acrylonitrile polymer, or the like. Of these, the fibers formed from PET, PBT, polyamide 6, polyamide 66, or the like are preferable from an industrial standpoint.

Specific examples of the removed component of the islands-in-the-sea composite fibers used to form the above-mentioned textile include polystyrene and copolymers thereof, polyethylene, PVA resins, copolymerized polyesters, and copolymerized polyamides. Of these, PVA resins can be used to advantage in terms of resulting in greater shrinkage during removal by dissolution.

(3) Wet Heat Shrinkage Treatment Step

Next, the wet heat shrinkage treatment step for raising the fiber density and degree of entanglement of the web entangled sheet by subjecting the web entangled sheet to wet heat shrinkage will be described. In this step, because a web entangled sheet containing long fibers is subjected to wet heat shrinkage, the web entangled sheet can be shrunken in a greater extent, and therefore the fiber density of the ultrafine fibers can be raised higher, compared to a case where a web entangled sheet containing short fibers is subjected to wet heat shrinkage.

The wet heat shrinkage treatment is preferably accomplished by steam heating.

The steam heating conditions preferably involve heat treatment for 60 to 600 seconds at an atmosphere temperature of between 60 and 130° C. and a relative humidity of at least 75%, and more preferably a relative humidity of at least 90%. These heating conditions are preferable because the web entangled sheet can be shrunken in a high shrinkage ratio. If the relative humidity is too low, there will be a tendency for the moisture in contact with the fibers to evaporate quickly, resulting in inadequate shrinkage.

The wet heat shrinkage treatment preferably involves shrinking the web entangled sheet to a surface area shrinkage ratio of at least 35%, and more preferably at least 40%. Shrinking to such a high shrinkage ratio gives a higher fiber density. There are no particular restrictions on the upper limit to this surface area shrinkage ratio, but it is preferably about 80% or less in terms of treatment efficiency and the limit of shrinkage.

The surface area shrinkage ratio (%) is calculated from the following equation (1):

$$(\text{surface area of the sheet prior to shrinkage treatment} - \text{surface area of the sheet after shrinkage treatment}) \div \text{surface area of the sheet prior to shrinkage treatment} \times 100 \quad (1)$$

The above-mentioned surface area refers to the average surface area for the surface and back sides of the sheet.

The fiber density of the web entangled sheet that has undergone this wet heat shrinkage treatment may be further increased by using a heating roll or heating press at a temperature over the thermal deformation temperature of the islands-in-the-sea composite fibers.

The change in the basis weight of the web entangled sheet before and after the wet heat shrinkage treatment is preferably such that the basis weight after shrinkage is at least 1.2 times (mass ratio), and more preferably at least 1.5 times, and preferably no more than 4 times, and more preferably no more than 3 times, compared to the basis weight before shrinkage.

(4) Fiber Bundle Bonding Step

Prior to subjecting the web entangled sheet to the treatment to form the ultrafine fibers, for the purpose of improving the form stability of the web entangled sheet, or for the purpose of reducing the percentage of void of the resulting polishing pad, the fiber bundles may be preliminarily bonded together, if needed, by impregnating the shrink-treated web entangled sheet with an aqueous solution of the macromolecular elastomer and then drying and solidifying.

In this step, by impregnating the shrink-treated web entangled sheet with the aqueous solution of the macromolecular elastomer and then drying and solidifying, the web entangled sheet is filled with the macromolecular elastomer. The macromolecular elastomer component can be formed by impregnating with the macromolecular elastomer in the form of the aqueous solution and then drying and solidifying. The aqueous solution of the macromolecular elastomer has a high concentration and low viscosity, and also has excellent impregnation permeability, so good filling is easy to accomplish. Also, adhesion to the fibers is excellent. Therefore, the macromolecular elastomer filled in this step securely binds the islands-in-the-sea composite fibers being the long fibers.

The macromolecular elastomer aqueous solution is an aqueous solution obtained by dissolving the component that forms the macromolecular elastomer in an aqueous solvent, or an aqueous dispersion obtained by dispersing the component that forms the macromolecular elastomer in an aqueous medium. The aqueous dispersion here includes suspensions and emulsions. Using the aqueous dispersion is preferable because the water resistance will be particularly good.

As the macromolecular elastomer, a hydrogen-bondable macromolecular elastomer is preferable in terms of good adhesion to the ultrafine fibers. The resin that forms the hydrogen-bondable macromolecular elastomer is, for example, a polyurethane resin, a polyamide resin, a polyvinyl alcohol resin, or the like, which gives a macromolecular elastomer that crystallizes or agglomerates through hydrogen bonding. A hydrogen-bondable macromolecular elastomer has good adhesive properties, increases the shape retention of the fiber-entangled body, and reduces the loosening of fibers.

A typical example of using a polyurethane resin as the macromolecular elastomer will now be described in detail.

Examples of polyurethane resins include various kinds of polyurethane resin obtained by reacting a macromolecular polyol with an average molecular weight of 200 to 6000, an organic polyisocyanate, and a chain extender in a specific molar ratio.

Specific examples of the above-mentioned macromolecular polyol include polyethylene glycol, polypropylene glycol, polytetramethylene glycol, poly(methyltetramethylene glycol), and other such polyether polyols and copolymers thereof; polybutylene adipate diol, polybutylene sebacate diol, polyhexamethylene adipate diol, poly(3-methyl-1,5-pentylene adipate) diol, poly(3-methyl-1,5-pentylene sebacate) diol, polycaprolactone diol, and other such polyester polyols and copolymers thereof; poly(hexamethylene carbonate) diol, poly(3-methyl-1,5-pentylene carbonate) diol, polypentamethylene carbonate diol, polytetramethylene carbonate diol, and other such polycarbonate polyols and copolymers thereof; and polyester carbonate polyols. If needed, a trifunctional alcohol such as trimethylolpropane, a tetrafunctional alcohol such as pentaerythritol, or another such polyfunctional alcohol, or ethylene glycol, propylene glycol, 1,4-butanediol, 1,6-hexanediol, or another such short-chain alcohol be used concurrently. These may be used singly, or two or more types may be combined. It is particularly favorable to use a non-crystalline polycarbonate polyol, an alicyclic polycarbonate polyol, a straight-chain polycarbonate polyol, or a mixture of one of these polycarbonate polyols with a polyether polyol or a polyester polyol, because the resulting polishing pad will have superior hydrolysis resistance, oxidation resistance, and such durability characteristics. Also, in terms of obtaining especially good wettability with water, it is preferable to use a polyurethane resin containing a polyalkylene glycol group with a carbon number of 5 or less, and particularly 3 or less.

Specific examples of the above-mentioned organic polyisocyanate include hexamethylene diisocyanate, isophorone diisocyanate, norbornene diisocyanate, 4,4'-dicyclohexylmethane diisocyanate, or another such aliphatic or alicyclic diisocyanate or other such non-yellowing diisocyanate; and 2,4-tolylene diisocyanate, 2,6-tolylene diisocyanate, 4,4'-diphenylmethane diisocyanate, xylylene diisocyanate polyurethane, or another such aromatic diisocyanate. If needed, a trifunctional isocyanate, a tetrafunctional isocyanate, or another such polyfunctional isocyanate may be used concurrently. These may be used singly, or two or more types may be combined. Of these, 4,4'-dicyclohexylmethane diisocyanate, 2,4-tolylene diisocyanate, 2,6-tolylene diisocyanate, 4,4'-diphenylmethane diisocyanate, and xylylene diisocyanate are preferable because the adhesion to the fibers will be better and a harder polishing pad will be obtained.

Specific examples of the above-mentioned chain extender include hydrazine, ethylenediamine, propylenediamine, hexamethylenediamine, nonamethylenediamine, xylylenediamine, isophoronediamine, piperazine and derivatives thereof, adipic acid dihydrazide, isophthalic acid dihydrazide, and other such diamines; diethylenetriamine and other such triamines; triethylenetetramine and other such tetramines; ethylene glycol, propylene glycol, 1,4-butanediol, 1,6-hexanediol, 1,4-bis(β-hydroxyethoxy)benzene, 1,4-cyclohexanediol, and other such diols; trimethylolpropane and other such triols; pentaerythritol and other such pentaols; and aminoethyl alcohol, aminopropyl alcohol, and other such aminoalcohols. These can be used singly or in combinations of two or more. Of these, using a combination of two or more compounds selected from among hydrazine, piperazine, hexamethylenediamine, isophoronediamine, and derivatives thereof, and ethylenetriamine and other such triamines is preferable in terms of concluding the curing reaction in a short time. Also, ethylamine, propylamine, butylamine, or another such monoamine; 4-aminobutanoic acid, 6-aminohexanoic acid, or another such monoamine compound containing a carboxy group; and methanol, ethanol, propanol, butanol, and other such mono-ols may be used together with a chain extender in the chain extending reaction.

Also, 2,2-bis(hydroxymethyl)propionic acid, 2,2-bis (hydroxymethyl)butanoic acid, 2,2-bis(hydroxymethyl)valeric acid, or another such diol that contains a carboxyl group may be used concurrently to introduce a carboxyl group or other such ionic group into the skeleton of the polyurethane elastomer, thereby further improving wettability with water.

Also, to control the water absorbency and storage elastic modulus of the macromolecular elastomer, it is preferable to form a crosslinked structure by adding a crosslinking agent whose molecule contains two or more functional groups capable of reacting with the functional group had by the monomer units that form the polyurethane, or a self-crosslinking compound such as a polyisocyanate compound or a polyfunctional block isocyanate compound.

Examples of combinations of the functional group in the monomer unit with the functional group in the crosslinking agent include a carboxyl group and an oxazoline group, a carboxyl group and a carbodiimide group, a carboxyl group and an epoxy group, a carboxyl group and a cyclocarbonate group, a carboxyl group and an aziridine group, and a carbonyl group and a hydrazine derivative or a hydrazide derivative. Of these, a combination of a monomer unit having a carboxyl group with a crosslinking agent having an oxazoline group, a carbodiimide group, or an epoxy group; a combination of a monomer unit having a hydroxyl group or an amino group with a crosslinking agent having a blocked isocyanate group; and a combination of a monomer unit having a carbonyl group with a hydrazine derivative or a hydrazide derivative are particularly favorable because forming crosslinks will be easier, and the resulting polishing pad will have superior stiffness and abrasion resistance. In terms of maintaining the stability of the macromolecular elastomer aqueous solution, the crosslinked structure is preferably formed in a heat treatment step after the polyurethane resin has been applied to the fiber-entangled body. Of these, it is particularly favorable to use a carbodiimide group and/or oxazoline group that has excellent crosslinking performance and pot life characteristics, and poses no safety problems. Examples of crosslinking agents having a carbodiimide group include Carbodilite E-01, Carbodilite E-02, and Carbodilite V-02 made by Nisshinbo Industries. Examples of crosslinking agents having an oxazoline group include Epocros K-2010E, Epocros K-2020E, and Epocros WS-500 made by Nippon Shokubai. The amount in which the crosslinking agent is added, as the amount of an active component in the crosslinking agent with respect to the polyurethane resin is preferably 1 to 20 mass, more preferably 1.5 to 1 mass, and even more preferably 2 to 10 mass %.

In terms of increasing the stiffness of the fiber bundles and increasing adhesion to the ultrafine fibers, the amount in which the macromolecular polyol component is contained in the polyurethane resin is preferably no more than 65 mass %, and more preferably no more than 60 mass %. Keeping the amount to at least 40 mass %, and preferably at least 45 mass %, is preferable in terms of being able to suppress the occurrence of scratching by imparting suitable elasticity.

The polyurethane resin may further contain a penetrant, a defoamer, a lubricant, a water repellant, an oil repellant, a thickener, an extender, a curing accelerator, an antioxidant, a UV absorbent, a fluorescent agent, a mildew inhibitor, a foaming agent, a water-soluble macromolecular compound such as a polyvinyl alcohol or carboxylmethyl cellulose, a dye, a pigment, inorganic microparticles, or the like.

There are no particular restrictions on the method for making the polyurethane resin into the aqueous solution or the aqueous dispersion, and any known method can be used. More specifically, examples include a method in which dispersibility in an aqueous media is imparted to the polyurethane resin by adding a monomer unit having a hydrophilic group such as a carboxyl group, a sulfonic acid group, or a hydroxyl group, and a method in which a surfactant is added to the polyurethane resin to emulsify or suspend the resin. Also, such aqueous macromolecular elastomer has excellent wettability with water, and therefore is excellent in terms of being able to hold a large amount of abrasive grains uniformly.

Specific examples of the surfactant used in the above-mentioned emulsification or suspension include sodium laurate, ammonium laurate, polyoxyethylene tridecyl ether sodium acetate, sodium dodecylbenzenesulfonate, alkyl diphenyl ether sodium disulfonate, sodium diooxtylsulfosuccinate, and other such anionic surfactants; and polyoxyethylene nonyl phenyl ether, polyoxyethylene octyl phenyl ether, polyoxyethylene lauryl ether, polyoxyethylene stearyl ether, polyoxyethylene-polyoxypropylene copolymers, and other such nonionic surfactants. A so-called reactive surfactant that has reactivity may also be used. A heat-sensitive gelling property can also be imparted to the polyurethane resin by suitably selecting the dew point of the surfactant.

The average particle size in the aqueous dispersion of the polyurethane resin is preferably from 0.01 to 1 μm, and more preferably 0.03 to 0.5 μm.

In this step, to form the macromolecular elastomer, the aqueous solution of the macromolecular elastomer is used in place of an organic solvent solution of a macromolecular elastomer that was commonly used in the past. Using the aqueous solution of the macromolecular elastomer allows impregnation at a higher concentration with the resin solution containing the macromolecular elastomer. This also sufficiently lowers the percentage of void of the resulting polishing pad.

The solids concentration in the macromolecular elastomer aqueous solution is preferably at least 15 mass %, and more preferably at least 25 mass %, because this allows the percentage of void to be lowered sufficiently.

Examples of methods for impregnating the web entangled sheet with the macromolecular elastomer aqueous solution include a method using a knife coater, bar coater, or roll coater, as well as dipping.

The macromolecular elastomer can be solidified by drying the web entangled sheet that has been impregnated with the macromolecular elastomer aqueous solution. Examples of methods for drying include a method in which a heat treatment is performed in a 50 to 200° C. drying apparatus, and a method in which a heat treatment is performed in a dryer after infrared heating.

When the above-mentioned web entangled sheet is impregnated with the macromolecular elastomer aqueous solution and then dried, a uniform state of filling may be prevented by migration of this aqueous solution to the surface layer of the web entangled sheet. If this should happen, such migration can be suppressed by adjusting the particle size of the macromolecular elastomer in the aqueous solution; by adjusting the type or amount of ionic groups of the macromolecular elastomer, or changing the pH, etc., and thereby adjusting the stability; by concurrently using a water-soluble polyurethane compound, an association type of heat-sensitive gelling agent such as a water-soluble silicone compound, an association type of water-soluble thickener, a nonionic emulsifier, or a univalent or divalent alkali metal salt or alkaline earth metal salt, and thereby lowering the aqueous dispersion stability at about 40 to 100° C.; and so forth. If needed, the macromolecular elastomer may be allowed to migrate so that it is more prevalent on the surface.

(5) Ultrafine Fiber Formation Step

Next, the ultrafine fiber formation step, in which ultrafine fibers are formed by dissolving the water-soluble thermoplastic resin in hot water, will be described.

In this step, the ultrafine fibers are formed by removing the water-soluble thermoplastic resin. Here, voids are formed in the portions of the web entangled sheet from which the water-soluble thermoplastic resin is dissolved and extracted. The ultrafine fibers are bundled together by filling in these voids with the macromolecular elastomer in the subsequent macromolecular elastomer filling step.

The process of producing ultrafine fibers involves subjecting the web entangled sheet, or the composite of the web entangled sheet and the macromolecular elastomer, to a hot water heating treatment with water, an alkaline aqueous solution, an acidic aqueous solution, or the like, to dissolve away or decompose away the water-soluble thermoplastic resin.

As a specific example of the hot water heating treatment conditions, it is preferable if, for example, the material is soaked for 5 to 300 seconds in 65 to 90° C. hot water as a first stage, and is treated for 100 to 600 seconds in 85 to 100° C. as a second stage. To improve the dissolution efficiency, roll nipping, high-pressure water jetting, ultrasonic treatment, shower treatment, stirring, rubbing, or another such treatment may be performed as needed.

In this step, the ultrafine fibers are greatly crimped when the ultrafine fibers are formed by dissolving the water-soluble thermoplastic resin from the islands-in-the-sea composite fibers. This crimping increases the fiber density, so the fiber-entangled body having higher density is obtained.

(6) Macromolecular Elastomer Filling Step

Next, the step in which the interior of the ultrafine fiber bundles formed from the ultrafine fibers are filled with the macromolecular elastomer, which bundles the ultrafine fibers together and also bonds the fiber bundles together, will be described.

In the ultrafine fiber formation step (5), by subjecting the islands-in-the-sea composite fibers to the treatment that produces the ultrafine fibers, the water-soluble thermoplastic resin is removed, and thereby, voids are formed in the interior of the ultrafine fiber bundles. In this step, these voids are filled with the macromolecular elastomer, which bundles the ultrafine fibers together and decreases the percentage of void of the polishing pad. When the ultrafine fibers have formed fiber bundles, a capillary action promotes the impregnation with the macromolecular elastomer aqueous solution, so the ultrafine fibers tend to be bundled and confined better.

The macromolecular elastomer aqueous solution used in this step can be the similar macromolecular elastomer aqueous solution as those described for the fiber bundle bonding step (4).

The method for filling the interior of the ultrafine fiber bundles formed from ultrafine fibers with the macromolecular elastomer in this step can be the similar method as those used in the fiber bundle bonding step (4). The polishing pad is formed in this way.

After-Working of Polishing Pad

The polishing pad thus obtained may be subjected as needed to molding, planarization, napping, lamination, surface treatment, or other such after-working treatments.

The above-mentioned molding and planarization involve hot press molding to a specific thickness by grinding the resulting polishing pad, or cutting to a specific shape. The polishing pad is preferably ground to a thickness of about 0.5 to 3 mm.

The above-mentioned napping is a treatment in which mechanical frictional force or polishing force is imparted to the polishing pad surface by sandpaper, card cloth, diamond, or the like, which splits apart the bundled ultrafine fibers. This napping treatment fibrillates the fiber bundles present in the polishing pad surface layer and forms numerous ultrafine fibers on the surface.

The above-mentioned lamination is a treatment in which the resulting polishing pad is stuck to the substrate and laminate to adjust the stiffness. For example, if the polishing pad is laminated with an elastomer sheet with low hardness, the global flatness of the surface being polished (the overall flatness of the substrate being polished) can be further increased. Bonding in this lamination may be melt bonding, or bonding involving the use of an adhesive or a pressure-sensitive adhesive. Specific examples of the above-mentioned substrate include an elastic sponge composed of polyurethane or the like; a nonwoven cloth impregnated with polyurethane (such as Suba 400, made by Nitta Haas); natural rubber, nitrile rubber, polybutadiene rubber, silicone rubber, and other such rubbers; polyester thermoplastic elastomers, polyamide thermoplastic elastomers, fluorine thermoplastic elastomers, and other such elastic resin films composed of thermoplastic elastomers; foamed plastics; and knits, weaves, and other such sheet-form substrates.

The above-mentioned surface treatment is a treatment in which holes or grooves that are in the form of a lattice, concentric circles, spirals, or the like are formed in the surface of the polishing pad to adjust the capacity of holding or discharging the abrasive slurry.

Polishing Method

As an example of polishing using the polishing pad of the embodiment, chemical mechanical polishing (CMP) will now be described through reference to the simplified diagram in FIG. 4.

Figure 4:
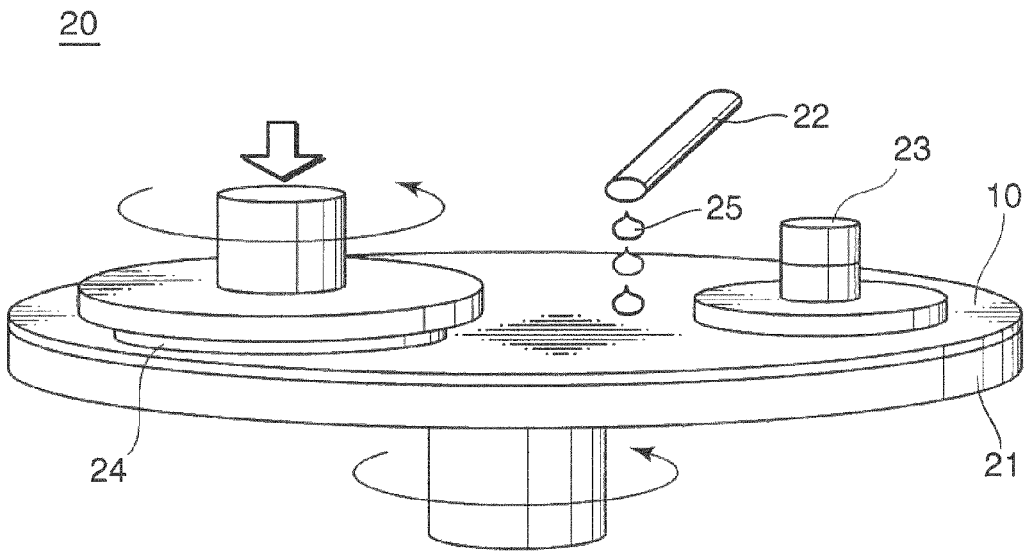
FIG. 4 is a diagram of chemical-mechanical polishing (CMP) using the polishing pad 10.

In FIG. 4, 20 is a polishing apparatus, 21 is a turntable, 22 is an abrasive slurry supply pipe, 23 is a conditioner, and 24 is a substrate being polished. A polishing pad 10 is affixed to the surface of the turntable 21.

The turntable 21 is rotated at high speed by a motor (not shown) provided to the polishing apparatus 20. In CMP, an abrasive slurry 25 is supplied a little at a time from the abrasive slurry supply pipe 22 to the polishing pad 10 affixed to the turntable 21 that is rotating at high speed. The surface of the substrate being polished 24 is polished by having a load applied to it by a load means (not shown) provided to the polishing apparatus 20. The surface of the polishing pad 10 is dressed by the conditioner 23 to reduce changes in polishing over time.

The abrasive slurry is obtained by dispersing a polishing agent such as silica, aluminum oxide, cerium oxide, zirconium oxide, silicon carbide in a liquid medium such as water or oil. The abrasive slurry may also contain a base, an acid, a surfactant, or other such components as needed.

A lubricating oil, a coolant, or the like may also be supplied as necessary along with the polishing slurry during CMP.

The above-mentioned conditioner can be diamond or another such dresser, preferably #50 to #1000, and more preferably #100 to #600. The conditioning may be performed before the substrate being polished 24 is polished, or during the polishing. Also, the conditioning of the polishing pad 10 and the polishing of the substrate being polished 24 may be carried out alternately. If the grit of the diamond dresser is too low, there will be a tendency for the surface to be rough, but if the grit is too high, there will be a tendency for the conditioning to take a long time.

The polishing pad of the embodiment can be used favorably in the polishing of silicon wafers, compound semiconductor wafers, semiconductor wafers, semiconductor devices, liquid crystal members, optical elements, quartz, optical substrates, electronic circuit substrates, electronic circuit mask substrates, multilayer wiring boards, hard disks, MEMS (micro-electro-mechanical system) substrates, and so forth.

Specific examples of semiconductor wafers and semiconductor devices include substrates having on their surface an insulating film of silicon oxide, silicon oxyfluoride, an organic polymer, or the like; a wiring metal film of copper, aluminum, tungsten, or the like; or a barrier metal film of tantalum, titanium, tantalum nitride, titanium nitride, or the like.

Also, the polishing pad can be used for primary polishing, secondary polishing (adjustment polishing), finish polishing, mirror finish polishing, or any other type of polishing. The polished portion may be the surface, back, or ends of the material.

The present invention will now be described in more specific terms by giving working examples, but the present invention is not limited in any way by these examples.

WORKING EXAMPLES

Working Example 1

An islands-in-the-sea composite fiber was formed by discharging a water-soluble thermoplastic polyvinyl alcohol resin (hereinafter referred to as PVA resin) and isophthalic acid-modified polyethylene terephthalate with a degree of modification of 6 mol % (hereinafter referred to as modified PET; Tg of 77° C., water absorbency of 1 mass, nominal water content of 0.4 mass %) in a ratio of 20:80 (mass ratio) from a composite melt spinning nozzle. The composite melt spinning nozzle had 25 islands per fiber and a nozzle temperature of 260° C. The ejector pressure was adjusted to achieve a spinning rate of 4000 m/min, and long fibers with an average size of 2.0 dtex were caught in a net to obtain a spun-bond sheet (long fiber web) with a basis weight of 30 g/m$^2$.

16 sheets of the spun-bond sheets thus obtained were cross-lapped to produce a lapped web with a total basis weight of 480 g/m$^2$. The lapped web thus obtained was sprayed with an oil to prevent needle breakage. Then, the lapped web was entangled by needle punching at 1800 punches/cm$^2$ using a No. 42 needle with one barb and a No. 42 needle with six barbs, which gave a web entangled sheet. The resulting web entangled sheet had a basis weight of 740 g/m$^2$ and an interlayer separation strength of 10.0 kg/2.5 cm. The surface area shrinkage produced by the needle punching had the shrinkage ratio of 35%.

Next, the web entangled sheet thus obtained was steam treated for 90 seconds at 70° C. and 95% RH. The surface area shrinkage ratio here was 50%. This product was then dried in a 140° C. oven, after which it was hot pressed at 140° C., which gave a web entangled sheet having a basis weight of 1480 g/m$^2$, an apparent density of 0.78 g/cm$^3$, and a thickness of 1.90 mm. The thickness of the web entangled sheet after hot pressing was 0.70 times the thickness prior to hot pressing.

Next, the hot pressed web entangled sheet was impregnated with a first polyurethane elastomer, which was an aqueous dispersion of a polyurethane elastomer A (with a solids concentration of 40 mass %). This polyurethane elastomer A was a non-yellowing polyurethane resin whose polyol component was a polycarbonate/polyether (6/4)-based polyol obtained by mixing a polycarbonate polyol, a $C_{2-3}$ polyalkylene glycol, and a $C_4$ polyalkylene glycol in a molar ratio of 6:0.5:3.5. The water absorbency of the polyurethane elastomer A was 5 mass %, and the storage elastic modulus at 150° C., "E' (150° C., dry)", was 60 MPa. The amount of solids adhesion of the aqueous dispersion here was 15 mass % with respect to the web entangled sheet. The web entangled sheet impregnated with the aqueous dispersion was dried and solidified under a 90° C. and 50% RH atmosphere, and then further dried at 140° C. This product was hot pressed at 140° C., which gave a sheet having a basis weight of 1700 g/m$^2$, an apparent density of 0.96 g/cm$^3$, and a thickness of 1.78 mm. The thickness of the web entangled sheet after hot pressing here was 0.88 times the thickness prior to hot pressing. The surface and back sides were buffed flat.

Next, the web entangled sheet filled with the polyurethane elastomer A was subjected to nipping and high-pressure water jetting while immersing for 10 minutes in 95° C. hot water, which dissolved away the PVA resin, and was then dried to obtain a composite of the polyurethane elastomer A and a fiber-entangled body in which the average size of the ultrafine fibers was 0.1 dtex, the basis weight was 1400 g/m$^2$, the apparent density was 0.76 g/cm$^3$, and the thickness was 1.85 mm.

This composite was impregnated with a second polyurethane elastomer, which was an aqueous dispersion of a polyurethane elastomer B (with a solids concentration of 35 mass %). This polyurethane elastomer B was a polyurethane resin produced in the way that 5 parts by mass of a carbodimide-based crosslinking agent was added to 100 parts by mass of a non-yellowing polyurethane resin obtained from a composition containing 1.5 mass % a carboxyl group-containing monomer, and whose polyol component was a mixture of a polycarbonate polyol and a $C_{2-3}$ polyalkylene glycol in a molar ratio of 99.8:0.2, and then a cross-linking structure was formed by heat treating this mixture. The water absorbency of the polyurethane elastomer B was 2 mass %, and the storage elastic modulus at 150° C., "E' (150° C., dry)", was 40 MPa. The amount of solids adhesion of the aqueous dispersion here was 15 mass % with respect to the mass of the web entangled sheet. The web entangled sheet impregnated with the aqueous dispersion was then solidified under a 90° C. and 50% RH atmosphere, and further dried at 140° C., which gave a polishing pad precursor. The polishing pad precursor thus obtained had a basis weight of 1570 g/m$^2$, an apparent density of 0.87 g/cm$^3$, and a thickness of 1.8 mm.

The polishing pad precursor thus obtained was ground and cut into a circular shape measuring 51 cm in diameter. Grooves 2.0 mm wide and 1.0 mm deep were formed on the surface in a lattice shape at a spacing of 15.0 mm, which gave a circular polishing pad with a basis weight of 1220 g/m$^2$, an apparent density of 0.87 g/cm$^3$, and a thickness of 1.4 mm.

Figure 5:
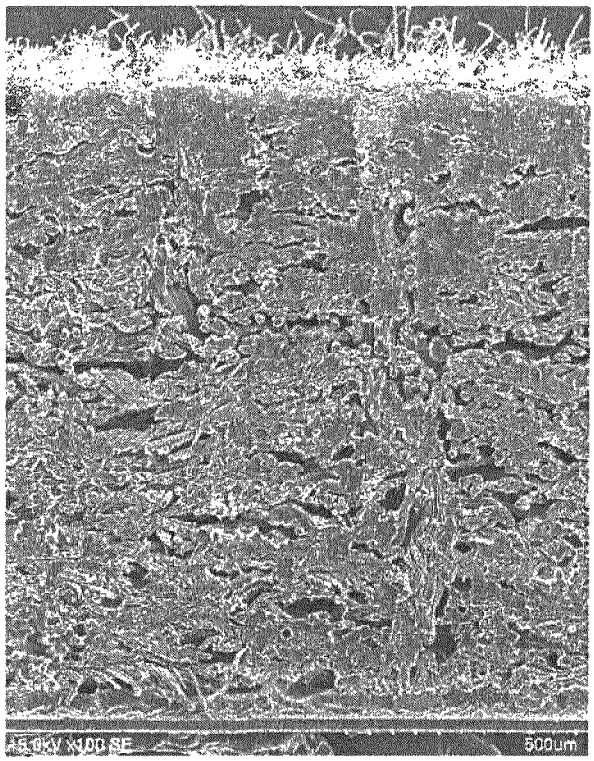
FIG. 5 is an SEM micrograph (100×) of the cross section in the thickness direction of the polishing pad obtained in Working Example 1.
Figure 6:
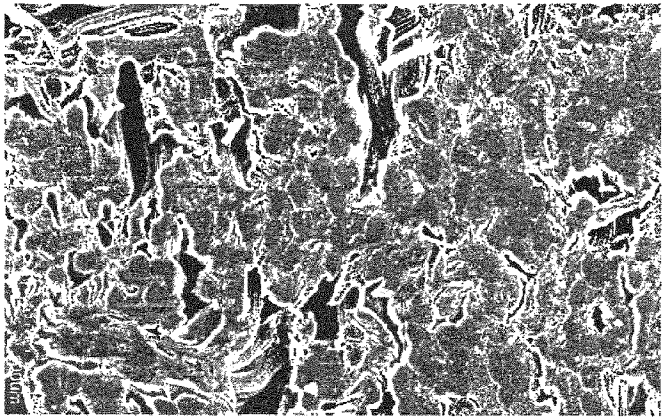
FIG. 6 is an SEM micrograph (500×) of the cross section in the thickness direction of the polishing pad obtained in Working Example 1.

The polishing pad thus obtained was evaluated by the methods described below. The results are given in Table 1. FIG. 5 is a 100×SEM micrograph of a cross section of this polishing pad, and FIG. 6 is a 500×SEM micrograph.

Working Example 2

An islands-in-the-sea composite fiber was formed by discharging the PVA resin and the modified PET in a ratio of 25:75 (mass ratio) from a composite melt spinning nozzle. The composite melt spinning nozzle had 25 islands per fiber and a nozzle temperature of 260° C. The ejector pressure was adjusted to achieve a spinning rate of 4000 m/min, and long fibers with an average size of 2.0 dtex were caught in a net to obtain a spun-bond sheet (long fiber web) with a basis weight of 30 g/m$^2$.

18 sheets of the spun-bond sheets thus obtained were cross-lapped to produce a lapped web with a total basis weight of 540 g/m$^2$. The stacked web thus obtained was sprayed with an oil to prevent needle breakage. Then, the stacked web was entangled by needle punching at 1800 punches/cm$^2$ using a No. 42 needle with one barb and a No. 42 needle with six barbs, which gave a web entangled sheet. The resulting web entangled sheet had a basis weight of 830 g/m$^2$ and an interlayer separation strength of 12.0 kg/2.5 cm. The surface area shrinkage rate after the needle punching was 35%.

Next, the web entangled sheet thus obtained was steam treated for 90 seconds at 70° C. and 95% RH. The surface area shrinkage rate here was 52%. This product was then dried in a 140° C. oven, after which it was hot pressed at 140° C., which gave a web entangled sheet having a basis weight of 1720 g/m$^2$, an apparent density of 0.80 g/cm$^3$, and a thickness of 2.15 mm. The thickness of the web entangled sheet after hot pressing was 0.70 times the thickness prior to hot pressing.

Next, the hot pressed web entangled sheet was impregnated with a first polyurethane elastomer, which was an aqueous dispersion of the polyurethane elastomer A (with a solids concentration of 40 mass %). The amount of solids adhesion of the aqueous dispersion here was 17 mass % with respect to mass of the web entangled sheet. The web entangled sheet impregnated with the aqueous dispersion was dried and solidified under a 90° C. and 50% RH atmosphere, and then further dried at 140° C. This product was hot pressed at 140° C., which gave a sheet having a basis weight of 2000 g/m$^2$, an apparent density of 1.03 g/cm$^3$, and a thickness of 1.9 mm. The thickness of the web entangled sheet after hot pressing here was 0.90 times the thickness prior to hot pressing. The surface and back sides were buffed flat.

Next, the web entangled sheet filled with the polyurethane elastomer A was subjected to nipping and high-pressure water jetting while soaking for 10 minutes in 95° C. hot water, which dissolved away the PVA resin, and was then dried to obtain a composite of the polyurethane elastomer A and a fiber-entangled body in which the average size of the ultrafine fibers was 0.085 dtex, the basis weight was 1440 g/m$^2$, the apparent density was 0.78 g/cm$^3$, and the thickness was 1.85 mm.

This composite was impregnated with a second polyurethane elastomer, which was an aqueous dispersion of a polyurethane elastomer C (with a solids concentration of 40 mass %). This polyurethane elastomer C was a macromolecular elastomer in which a crosslinked structure was formed by adding 7 parts by mass of a carbodimide-based crosslinking agent to 100 parts by mass of a non-yellowing polyurethane resin obtained from a composition containing 2.0 mass % a carboxyl group-containing monomer, and whose polyol component was a polycarbonate polyol, and then by heat treating this mixture. The water absorbency of the polyurethane elastomer C was 1 mass %, and the storage elastic modulus at 150° C., "E' (150° C., dry)", was 50 MPa. The amount of solids adhesion of the aqueous dispersion here was 17 mass % with respect to the mass of the web entangled sheet. The web entangled sheet impregnated with the aqueous dispersion was then solidified under a 90° C. and 50% RH atmosphere, and further dried at 140° C., which gave a polishing pad precursor. The polishing pad precursor thus obtained had a basis weight of 1720 g/m$^2$, an apparent density of 0.92 g/cm$^3$, and a thickness of 1.85 mm.

The polishing pad precursor thus obtained was ground and cut into a circular shape measuring 51 cm in diameter. Grooves 2.0 mm wide and 1.0 mm deep were formed on the surface in a lattice shape at a spacing of 15.0 mm, which gave a circular polishing pad with a basis weight of 1560 g/m$^2$, an apparent density of 0.92 g/cm$^3$, and a thickness of 1.7 mm. The polishing pad thus obtained was evaluated by the methods described below. The results are given in Table 1.

Working Example 3

An islands-in-the-sea composite fiber was formed by discharging the PVA resin and the modified PET in a ratio of 20:80 (mass ratio) from a composite melt spinning nozzle. The composite melt spinning nozzle had 25 islands per fiber and a nozzle temperature of 260° C. The ejector pressure was adjusted to achieve a spinning rate of 4000 m/min, and long fibers with an average size of 2.0 dtex were caught in a net to obtain a spun-bond sheet (long fiber web) with a basis weight of 30 g/m$^2$.

18 sheets of the spun-bond sheets thus obtained were cross-lapped to produce a lapped web with a total basis weight of 540 g/m$^2$. The lapped web thus obtained was sprayed with an oil to prevent needle breakage. Then, the lapped web was entangled by needle punching at 2000 punches/cm$^2$ using a No. 42 needle with one barb and a No. 42 needle with six barbs, which gave a web entangled sheet. The resulting web entangled sheet had a basis weight of 870 g/m$^2$ and an interlayer separation strength of 13.0 kg/2.5 cm. The surface area shrinkage rate after the needle punching was 38%.

Next, the web entangled sheet thus obtained was steam treated for 90 seconds at 70° C. and 95% RH. The surface area shrinkage here was 52%. This product was then dried in a 120° C. oven, after which it was hot pressed at 140° C., which gave a web entangled sheet having a basis weight of 1800 g/m$^2$, an apparent density of 0.82 g/cm$^3$, and a thickness of 2.2 mm. The thickness of the web entangled sheet after hot pressing was 0.72 times the thickness prior to hot pressing.

Next, the hot pressed web entangled sheet was impregnated with a first polyurethane elastomer, which was an aqueous dispersion of the polyurethane elastomer A (with a solids concentration of 40 mass %). The amount of solids adhesion of the aqueous dispersion here was 13 mass % with respect to mass of the web entangled sheet. The web entangled sheet impregnated with the aqueous dispersion was dried and solidified under a 90° C. and 50% RH atmosphere, and then further dried at 140° C. This product was hot pressed at 140° C., which gave a sheet having a basis weight of 1800 g/m$^2$, an apparent density of 0.82 g/cm$^3$, and a thickness of 2.2 mm. The thickness of the web entangled sheet after hot pressing here was 0.90 times the thickness prior to hot pressing Next, the web entangled sheet filled with the polyurethane elastomer A was subjected to nipping and high-pressure water jetting while soaking for 10 minutes in 95° C. hot water, which dissolved away the PVA resin, and was then dried to obtain a composite of the polyurethane elastomer A and a fiber-entangled body in which the average size of the ultrafine fibers was 0.09 dtex, the basis weight was 1640 g/m$^2$, the apparent density was 0.82 g/cm$^3$, and the thickness was 2.0 mm.

This composite was impregnated with a second polyurethane elastomer, which was an aqueous dispersion of the polyurethane elastomer B (with a solids concentration of 40 mass %). The amount of solids adhesion of the aqueous dispersion here was 16 mass % with respect to the mass of the web entangled sheet. The web entangled sheet impregnated with the aqueous dispersion was then solidified under a 140° C. and 50% RH atmosphere, and further dried at 140° C., which gave a polishing pad precursor. The polishing pad precursor thus obtained had a basis weight of 1910 g/m$^2$, an apparent density of 0.95 g/cm$^3$, and a thickness of 2.0 mm.

The polishing pad precursor thus obtained was ground and cut into a circular shape measuring 51 cm in diameter. Grooves 2.0 mm wide and 1.0 mm deep were formed on the surface in a lattice shape at a spacing of 15.0 mm, which gave a circular polishing pad with a basis weight of 1520 g/m$^2$, an apparent density of 0.95 g/cm$^3$, and a thickness of 1.6 mm. The polishing pad thus obtained was evaluated by the methods described below. The results are given in Table 1.

Working Example 4

A hot-pressed web entangled sheet was obtained in the same manner as in Working Example 2 up to the step of hot-pressing the web entangled sheet.

Next, the hot-pressed web entangled sheet was soaked for 10 minutes in 95° C. hot water to dissolve away the PVA resin, which gave a fiber-entangled body composed of fiber bundles of ultrafine fibers. The fiber-entangled body thus obtained was impregnated with an aqueous dispersion of the polyurethane elastomer A (with a solids concentration of 50 mass %). The amount of solids adhesion of the aqueous dispersion here was 44 mass % with respect to mass of the web entangled sheet. The fiber-entangled body impregnated with the aqueous dispersion was solidified under a 90° C. and 50% RH atmosphere, and then further dried at 140° C., after which it was hot pressed at 140° C., which gave a polishing pad precursor. The polishing pad precursor thus obtained was after-worked in the same manner as in Working Example 2, which gave a circular polishing pad having a basis weight of 1500 g/m$^2$, an apparent density of 0.88 g/cm$^3$, and a thickness of 1.7 mm. The polishing pad thus obtained was evaluated by the methods described below. The results are given in Table 1.

Working Example 5

A hot-pressed web entangled sheet was obtained in the same manner as in Working Example 3 up to the step of hot-pressing the web entangled sheet.

Next, the hot-pressed web entangled sheet was soaked for 10 minutes in 95° C. hot water to dissolve away the PVA resin, which gave a fiber-entangled body composed of fiber bundles of ultrafine fibers. The fiber-entangled body thus obtained was impregnated with an aqueous dispersion of the polyurethane elastomer B (with a solids concentration of 40 mass %). The amount of solids adhesion of the aqueous dispersion here was 30 mass % with respect to mass of the web entangled sheet. The fiber-entangled body impregnated with the aqueous dispersion was solidified under a 90° C. and 50% RH atmosphere, and then further dried at 140° C., after which it was hot pressed at 140° C., which gave a polishing pad precursor. The polishing pad precursor thus obtained was after-worked in the same manner as in Working Example 3, which gave a circular polishing pad having a basis weight of 1390 g/m$^2$, an apparent density of 0.87 g/cm$^3$, and a thickness of 1.6 mm. The polishing pad thus obtained was evaluated by the methods described below. The results are given in Table 1.

Working Example 6

A polishing pad was obtained in the same manner as in Working Example 1, except that the aqueous dispersion of the first polyurethane elastomer (polyurethane elastomer A) and the aqueous dispersion of the second polyurethane elastomer (polyurethane elastomer B) were each adjusted to a solids concentration of 25 mass %, so that the amount of solids adhesion of the aqueous dispersion was 12 mass % with respect to the mass of the web entangled sheet in each case. The polishing pad thus obtained had a basis weight of 1190 g/m$^2$, an apparent density of 0.85 g/cm$^3$, and a thickness of 1.4 mm. The polishing pad fill ratio was 60% and the mass ratio between the fiber-entangled body and the polyurethane elastomer was 85/15. The polishing pad thus obtained was evaluated by the methods described below. The results are given in Table 1.

Working Example 7

A polishing pad was obtained in the same manner as in Working Example 1, except that in the structure of the islands-in-the-sea composite fibers, the ratio of the PVA resin and the modified PET was changed from 20:80 to 15:85, and the solids concentrations of the aqueous dispersion of the first polyurethane elastomer and of the aqueous dispersion of the second polyurethane elastomer were each 50 mass %. The polishing pad thus obtained had a basis weight of 1570 g/m$^2$, an apparent density of 1.12 g/cm$^3$, and a thickness of 1.4 mm. The polishing pad fill ratio was 90% and the mass ratio between the fiber-entangled body and the polyurethane elastomer was 58/42. The polishing pad thus obtained was evaluated by the methods described below. The results are given in Table 1.

Working Example 8

A polishing pad was obtained in the same manner as in Working Example 2, except that in the structure of the islands-in-the-sea composite fibers, the ratio of the PVA resin and the modified PET was changed from 25:75 to 15:85, and the solids concentrations of the aqueous dispersion of the first polyurethane elastomer and of the aqueous dispersion of the second polyurethane elastomer were each 50 mass %. The polishing pad thus obtained had a basis weight of 1900 g/m$^2$, an apparent density of 1.12 g/cm$^3$, and a thickness of 1.7 mm. The polishing pad fill ratio was 90% and the mass ratio between the fiber-entangled body and the polyurethane elastomer was 58/42. The polishing pad thus obtained was evaluated by the methods described below. The results are given in Table 1.

Working Example 9

A polishing pad was obtained in the same manner as in Working Example 1, except that instead of the web entangled sheet being steam treated for 90 seconds at 70° C. and 95% RH to obtain a surface area shrinkage rate of 50%, the web entangled sheet was steam treated for 90 seconds at 70° C. and 60% RH to obtain a surface area shrinkage rate of 35%. The shrunken and hot-pressed web entangled sheet thus obtained had a basis weight of 1140 g/m$^2$, an apparent density of 0.60 g/cm$^3$, and a thickness of 1.90 mm.

The polishing pad thus obtained had a basis weight of 1020 g/m$^2$, an apparent density of 0.73 g/cm$^3$, and a thickness of 1.4 mm. The polishing pad fill ratio was 58% and the mass ratio between the fiber-entangled body and the polyurethane elastomer was 65/35. The polishing pad thus obtained was evaluated by the methods described below. The results are given in Table 1.

Working Example 10

A polishing pad was obtained in the same manner as in Working Example 2, except that instead of the web entangled sheet being steam treated for 90 seconds at 70° C. and 95% RH to obtain a surface area shrinkage rate of 52%, the web entangled sheet was steam treated for 90 seconds at 70° C. and 60% RH to obtain a surface area shrinkage rate of 35%. The shrunken and hot-pressed web entangled sheet thus obtained had a basis weight of 1290 g/m$^2$, an apparent density of 0.60 g/cm$^3$, and a thickness of 2.15 mm.

A polishing pad was obtained in the same manner as in Working Example 2, except that the shrunken web entangled sheet thus obtained was used, and the solids concentration of the first polyurethane elastomer and of the aqueous dispersion of the second polyurethane elastomer were each changed to 25 mass %. The polishing pad thus obtained had a basis weight of 1190 g/m$^2$, an apparent density of 0.72 g/cm$^3$, and a thickness of 1.7 mm. The polishing pad fill ratio was 58% and the mass ratio between thefiber-entangled body and the polyurethane elastomer was 67/33. The polishing pad thus obtained was evaluated by the methods described below. The results are given in Table 1.

Working Example 11

A polishing pad was manufactured in the same manner as in Working Example 1, except that the solids concentration of the aqueous dispersion of the second polyurethane elastomer was changed to 10%. The polishing pad thus obtained had a basis weight of 1120 g/m$^2$, an apparent density of 0.80 g/cm$^3$, and a thickness of 1.4 mm. The polishing pad fill ratio was 62% and the mass ratio between the fiber-entangled body and the polyurethane elastomer was 78/22. The polishing pad thus obtained was evaluated by the methods described below. The results are given in Table 1.

Working Example 12

A polishing pad was obtained in the same manner as in Working Example 2, except that a nozzle for the melt spinning of 5 islands per fiber was used instead of the nozzle for the melt spinning of 25 islands per fiber to form the islands-in-the-sea composite fibers. The polishing pad thus obtained had a basis weight of 1580 g/m$^2$, an apparent density of 0.88 g/cm$^3$, and a thickness of 1.8 mm. SEM observation revealed the fiber density on the surface to be 700 fibers/mm$^2$. The polishing pad thus obtained was evaluated by the methods described below. The results are given in Table 1.

Working Example 13

A polishing pad was obtained in the same manner as in Working Example 1, except that the PVA resin and a copolymer of polyamide 6/polyamide 12 (Tg of 45° C., water absorbency of 7 mass %) in a ratio of 25:75 was used instead of using the PVA resin and the modified PET in a ratio of 20:80 in the formation of the islands-in-the-sea composite fibers. The polishing pad thus obtained had a basis weight of 1150 g/m$^2$, an apparent density of 0.82 g/cm$^3$, a thickness of 1.4 mm, and a D hardness of 54. The mass ratio between the fiber-entangled body and the polyurethane elastomer was 68/32. The polishing pad thus obtained was evaluated by the methods described below. The results are given in Table 1.

Working Example 14

A polishing pad was obtained in the same manner as in Working Example 2, except that a copolymer polyamide of polyamide 6/polyamide 12/polyamide 66 (Tg of 55° C., water absorbency of 6 mass %) was used instead of the modified PET in the formation of the islands-in-the-sea composite fibers. The polishing pad thus obtained had a basis weight of 1390 g/m$^2$, an apparent density of 0.80 g/cm$^3$, and a thickness of 1.7 mm. The polishing pad thus obtained was evaluated by the methods described below. The results are given in Table 1.

Working Example 15

A polishing pad was obtained in the same manner as in Working Example 3, except that a polyamide 6/12 copolymer (Tg of 45° C., water absorbency of 7 mass %) was used instead of the modified PET in the formation of the islands-in-the-sea composite fibers. The polishing pad thus obtained had a basis weight of 1390 g/m$^2$, an apparent density of 0.82 g/cm$^3$, and a thickness of 1.7 mm. The polishing pad thus obtained was evaluated by the methods described below. The results are given in Table 1.

Working Example 16

A polishing pad was produced in the same manner as in Working Example 3, except that a non-yellowing polyurethane elastomer (water absorbency of 15%, 150° C. storage elastic modulus, "E' (150° C., dry)", of 50 MPa) having a crosslinked structure obtained using a polyether-based polyalkylene glycol as the polyol component was used instead of the polyurethane elastomer A as the first polyurethane elastomer, and a non-yellowing polyurethane elastomer (water absorbency of 8%, 150° C. storage elastic modulus, "E' (150° C., dry)", of 10 MPa) having a crosslinked structure and containing an aqueous dispersion polyether-based carboxyl group was used instead of the polyurethane elastomer B as the second polyurethane elastomer. The water absorbency of the macromolecular elastomer exhibited 12% on average. The ratio of "E' (23° C., wet)"/"E' (50° C., wet)" was 1.7, and the ratio of "E' (50° C., dry)"/"E' (50° C., wet)" was 3.0. The polishing pad thus obtained was evaluated by the methods described below. The results are given in Table 1.

Comparative Example 1

An islands-in-the-sea composite fiber was formed by discharging the PVA resin and the modified PET in a ratio of 20:80 (mass ratio) from a composite melt spinning nozzle. The islands-in-the-sea composite fibers thus obtained were drawn and crimped, and then cut to obtain short fibers with a fineness of 4 dtex and a length of 51 mm. The short fibers thus obtained were carded and cross-lapped to obtain a short fiber web with a basis weight of 30 g/m$^2$.

A polishing pad was produced and evaluated in the same manner as in Working Example 1, except that the short fiber web obtained above was used instead of the spun-bond sheet (long fiber web). The surface area shrinkage rate was 30% when the web entangled sheet obtained from this short fiber web was steam treated. The polishing pad thus obtained was evaluated by the methods described below. The results are given in Table 2.

Comparative Example 2

An islands-in-the-sea composite fiber was formed by discharging the PVA resin and the modified PET in a ratio of 40:60 (mass ratio) from a composite melt spinning nozzle. The islands-in-the-sea composite fibers thus obtained were drawn and crimped, and then cut to obtain short fibers with a fineness of 6 dtex and a length of 51 mm. The short fibers thus obtained were carded and cross-lapped to obtain a short fiber web with a basis weight of 30 g/m$^2$.

A polishing pad was produced and evaluated in the same manner as in Working Example 2, except that the short fiber web obtained above was used instead of the spun-bond sheet (long fiber web). The surface area shrinkage rate was 30% when the web entangled sheet obtained from this short fiber web was steam treated. The polishing pad thus obtained was evaluated by the methods described below. The results are given in Table 2.

Comparative Example 3

An islands-in-the-sea composite fiber was formed by discharging the PVA resin and the modified PET in a ratio of 40:60 (mass ratio) from a composite melt spinning nozzle. The islands-in-the-sea composite fibers thus obtained were drawn and crimped, and then cut to obtain short fibers with a fineness of 6 dtex and a length of 51 mm. The short fibers thus obtained were carded and cross-lapped to obtain a short fiber web with a basis weight of 30 g/m$^2$.

A polishing pad was produced and evaluated in the same manner as in Working Example 3, except that the short fiber web obtained above was used instead of the spun-bond sheet (long fiber web). The surface area shrinkage rate was 30% when the web entangled sheet obtained from this short fiber web was steam treated. The polishing pad thus obtained was evaluated by the methods described below. The results are given in Table 2.

Comparative Example 4

A spun-bond sheet (long fiber web) with a basis weight of 30 g/m$^2$ was obtained by melt spinning PET long fibers with an average size of 2 dtex obtained by the melt spinning of the modified PET, and then by catching the resulting long fibers in a net.

A lapped web was produced in the same manner as in Working Example 2 from the spun-bond sheet thus obtained. The lapped web thus obtained was entangled by needle punching in the same manner as in Working Example 2 to obtain a web entangled sheet. The web entangled sheet thus obtained had a basis weight of 840 g/m$^2$ and an interlayer separation strength of 12 kg/2.5 cm. Next, the web entangled sheet thus obtained was steam treated for 90 seconds at 70° C. and 95% RH, then dried in a 140° C. oven, after which it was hot pressed at 140° C. to obtain a web entangled sheet.

Next, the hot-pressed web entangled sheet was impregnated with an aqueous dispersion of the polyurethane elastomer A (with a solids concentration of 40 mass %). The amount of solids adhesion of the aqueous dispersion here was 17 mass % with respect to the web entangled sheet. The web entangled sheet impregnated with the aqueous dispersion was solidified under a 90° C. and 90% RH atmosphere, and then further dried at 140° C. The surface and back sides were buffed flat to obtain a polishing pad. The polishing pad thus obtained was evaluated by the methods described below. The results are given in Table 2.

Comparative Example 5

A polishing pad was obtained in the same manner as in Working Example 1, except that a spun-bond sheet with a basis weight of 30 g/m$^2$ obtained by catching PET long fibers with an average size of 0.2 dtex in a net was used instead of the spun-bond sheet composed of islands-in-the-sea composite fibers used in Working Example 1, and that the step of dissolving away the PVA resin was eliminated. SEM observation revealed that the ultrafine fibers of the polishing pad thus obtained had not formed fiber bundles. The polishing pad thus obtained was evaluated by the methods described below. The results are given in Table 2.

Comparative Example 6

Figure 7:
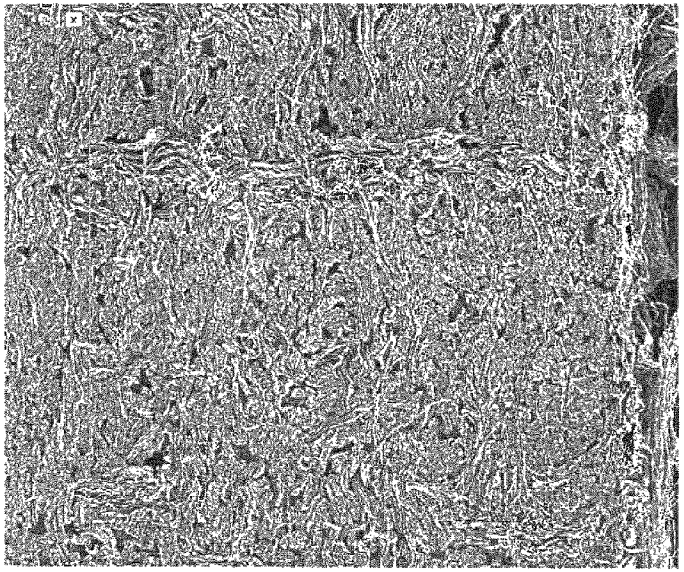
FIG. 7 is an SEM micrograph (100×) of the cross section in the thickness direction of the polishing pad obtained in Comparative Example 6.

A hot-pressure web entangled sheet manufactured in the same manner as in Working Example 1 was impregnated with an aqueous dispersion of the polyurethane elastomer A (with a solids concentration of 40 mass %). The amount of solids adhesion of the aqueous dispersion here was 30 mass % with respect to the web entangled sheet. The web entangled sheet impregnated with the aqueous dispersion was solidified under a 90° C. and 50% RH atmosphere, and then further dried at 140° C. The surface and back sides were buffed flat. Then, the web entangled sheet filled with the polyurethane elastomer A was soaked for 10 minutes in 95° C. hot water to dissolve away the PVA resin, and then dried to obtain a polishing pad. The polishing pad thus obtained was evaluated by the methods described below. The results are given in Table 2. Almost no polyurethane elastomer was present in the interior of the fiber bundles in the resulting polishing pad, and substantially no ultrafine fibers were bundled. FIG. 7 is a 100×SEM micrograph of a cross section of the obtained polishing pad.

Comparative Example 7

A hot-pressure web entangled sheet manufactured in the same manner as in Working Example 2 was impregnated with an aqueous dispersion of the polyurethane elastomer A (with a solids concentration of 40 mass %). The amount of solids adhesion of the aqueous dispersion here was 17 mass % with respect to the web entangled sheet. The web entangled sheet impregnated with the aqueous dispersion was solidified under a 90° C. and 50% RH atmosphere, and then further dried at 140° C. The surface and back sides were buffed flat. Then, the web entangled sheet filled with the polyurethane elastomer A was soaked for 10 minutes in 95° C. hot water to dissolve away the PVA resin, and then dried to obtain a polishing pad. The polishing pad thus obtained was evaluated by the methods described below. The results are given in Table 2. Almost no polyurethane elastomer was present in the interior of the fiber bundles in the resulting polishing pad, and substantially no ultrafine fibers were bundled.

Comparative Example 8

A polishing pad was produced in the same manner as in Working Example 1, except that instead of forming the polyurethane elastomer by using an aqueous dispersion of the polyurethane elastomer A as the macromolecular elastomer, a polyurethane elastomer was formed by impregnating with a solution (12% concentration) of polyurethane resin dissolved in N,N-dimethylformamide, and performing wet solidification in a mixed solution of DMF and water at 40° C. The polishing pad thus obtained was evaluated by the methods described below. The results are given in Table 2. The polishing pad thus obtained had a polishing pad fill ratio of 40%, and the polyurethane elastomer was present in porous form. SEM observation revealed that in the resulting polishing pad, a small amount of polyurethane elastomer was present in the interior of the fiber bundles, but the proportion of fiber bundles with a cross sectional area of at least 40 $\mu m^2$ was 5%.

Comparative Example 9

A polishing pad was produced in the same manner as in Working Example 2, except that instead of forming the polyurethane elastomer by using an aqueous dispersion of the polyurethane elastomer as the macromolecular elastomer, a polyurethane elastomer was formed by impregnating with a solution (12% solids concentration) of polyurethane resin dissolved in N,N-dimethylformamide, and performing wet solidification in a mixed solution of DMF and water at 40° C. The polishing pad thus obtained had a polishing pad fill ratio of 57%, and the polyurethane elastomer was present in porous form. SEM observation revealed that in the resulting polishing pad, a small amount of polyurethane elastomer was present in the interior of the fiber bundles, but the proportion of fiber bundles with a cross sectional area of at least 40 $\mu m^2$ was 5%. The fiber-entangled body fill ratio was 43%. The polishing pad thus obtained was evaluated by the methods described below. The results are given in Table 2. In the polishing performance evaluation, anti-scratching and polishing stability were poor, and the fibers were seen to fall out during polishing. There was also a great deal of clogging during polishing.

Comparative Example 10

A polishing pad was produced in the same manner as in Working Example 3, except that instead of forming the polyurethane elastomer by using an aqueous dispersion of the polyurethane elastomer as the macromolecular elastomer, a polyurethane elastomer was formed by impregnating with a solution (12% solids concentration) of polyurethane resin dissolved in N,N-dimethylformamide, and performing wet solidification in a mixed solution of DMF and water at 40° C. The polishing pad thus obtained was evaluated by the methods described below. The results are given in Table 2. The polyurethane elastomer was present in porous form in the polishing pad thus obtained. SEM observation of a cross section revealed that in the resulting polishing pad, a small amount of polyurethane elastomer was present in the interior of the fiber bundles, but the proportion of fiber bundles with a total cross sectional area of at least 40 $\mu m^2$/bundle was 5%. In the polishing performance evaluation, anti-scratching and polishing stability were poor, and the fibers were seen to fall out during polishing. There was also a great deal of clogging during polishing.

Comparative Example 11

A polishing pad was produced in the same manner as in Working Example 1, except that a spun-bond sheet obtained by catching PET long fibers with an average size of 2 dtex in a net was used instead of the spun-bond sheet composed of islands-in-the-sea composite fibers used in Working Example 1, and that the step of dissolving away the PVA resin was eliminated. The polishing pad thus obtained was evaluated by the methods described below. The results are given in Table 2.

Comparative Example 12

A polishing pad was produced in the same manner as in Working Example 1, except that methyl methacrylate monomer was made to penetrate a sheet and polymerized in nitrogen instead of filling with the polyurethane elastomer after conversion to ultrafine fibers. The polishing pad thus obtained was evaluated by the methods described below. The results are given in Table 2.

The polishing pads obtained above were evaluated by the following methods

Evaluation Methods (1) Average Cross Sectional Area of Ultrafine Fibers, and Confirmation of Bundling State of Ultrafine Fibers within Fiber Bundles A cutter blade was used to cut the resulting polishing pad in its thickness direction to form a cross section in the thickness direction. The cross section thus obtained was dyed with osmium oxide. This cross section was observed at a power of 500 to 1000×with a scanning electron microscope (SEM), and an image thereof was captured. The cross sectional area of the ultrafine fibers present in the cross section was found from the resulting image. The cross sectional area for 100 randomly selected samples was averaged to obtain the average cross sectional area. The image thus obtained was observed, and if not only the ultrafine fibers constituting the outer periphery of the fiber bundle, but also the interior ultrafine fibers were bundled in a state of being integrated by bonding by the macromolecular elastomer, this was rated as "yes," but if no macromolecular elastomer was present in the interior of the fiber bundles, or it was only present in a tiny amount, and the ultrafine fibers were substantially not bundled in a state of being bonded, this was rated as "no."

(2) Number of Fiber Bundles Per Unit of Surface Area (Fiber Bundle Density)

The image used in the "(1) Average Cross Sectional Area of Ultrafine Fibers, and Confirmation of Bundling State of Ultrafine Fibers within Fiber Bundles" was observed, and the number of fiber bundles that were substantially perpendicular to the cross section were counted from among the fiber bundles present in the cross section. The surface area of the portion in which the number of fiber bundles per image was counted was approximately 0.5 $mm^2$. The number of fiber bundles present per square millimeter was calculated by dividing the counted number of fiber bundles by 0.5 $mm^2$. The number of fiber bundles per unit of surface area was found for 10 images, the obtained 10 values were averaged, and this value was used as the number of fiber bundles per unit of surface area.

(3) Average Cross Sectional Area of Fiber Bundles, and Proportion of Fiber Bundles in which the Cross Sectional Area was at Least 40 $\mu m^2$/Bundle A polishing pad was cut into a plurality of pieces in random directions, and the cross sections thus obtained were dyed with osmium oxide. These cross sections were observed at a power of 500 to 1000×by SEM, and images thereof were captured. 1000 cross sections of fiber bundles were randomly selected from these obtained images. The cross sectional area of each fiber bundle was measured, and the average was found for the cross sectional area of the 1000 measured samples. The number of fiber bundles whose cross sectional area was at least 40 $\mu m^2$/bundle was counted, and the proportion (%) of fiber bundles whose cross sectional area was at least 40 $\mu m^2$ was found.

(4) Cross Sectional Area and Density of Ultrafine Fibers on Surface of Polishing Pad The surface of the polishing pad after polishing was dyed with osmium oxide. This dyed surface was observed by SEM at a power of 100 to 200×, and ten images were captured. The average cross sectional area and density of the ultrafine fibers (the number of ultrafine fibers per square millimeter) was found from each of the resulting images. The calculated average cross sectional area and density at ten points were averaged, and these values were used as the cross sectional area and density of the ultrafine fibers on the surface.

(5) Apparent Density of Polishing Pad and Polishing Pad Fill Ratio

The apparent density of the obtained polishing pad was measured according to JIS K 7112. Meanwhile, the theoretical density of a composite of a macromolecular elastomer and a fiber-entangled body when no voids were present was calculated from the ratios of the various constituent components of the polishing pad and from the density of these constituent components. The ratio of the above-mentioned apparent density to the above-mentioned theoretical density was termed the polishing pad fill ratio (the volumetric ratio of the portion excluding voids in the polishing pad). The density of the components is, for example, 1.38 $g/cm^3$ for the modified PET, 1.05 $g/cm^3$ for the polyurethane elastomer, and 1.25 $g/cm^3$ for the PVA resin.

(6) Volumetric Ratio of the Portion Excluding Voids in the Fiber-Entangled Body (Fiber-Entangled Body Fill Ratio)

The fiber-entangled body fill ratio was calculated by subtracting the macromolecular elastomer fill ratio obtained from the product of the density and the constituent ratio of the macromolecular elastomer from the polishing pad fill ratio found in (5).

(7) Water Absorbency of Polishing Pad Upon Swelling to Saturation with 50° C. Hot Water The polishing pad thus obtained was cut to a size of 4 cm long by 10 cm wide. This was left for 3 days to dry under conditions of 20° C. and 65% RH. Dipping in 50° C. hot water and nipping were repeated three times, after which the pad was soaked for 3 days in 50° C. hot water so that it swelled to saturation. The polishing pad was then removed from the hot water and any drops of water or the like clinging to the surface were wiped off with a JK Wiper 150-S (made by Crecia). The water absorbency upon swelling to saturation in 50° C. hot water was found using the following equation from the mass of the polishing pad immediately after drying and the mass after swelling to saturation.

Water absorbency (%)=[(mass of the polishing pad upon swelling to saturation−mass of the polishing pad immediately after drying)/(mass of the polishing pad immediately after drying)]×100

(8) Storage Elastic Modulus of Polishing Pad at 50° C.

The polishing pad thus obtained was cut to a length of 4 cm and a width of 0.5 cm to produce a sample. The thickness of the sample was measured by micrometer. A kinetic viscoelasticity measurement apparatus (DVE Rheospectora, made by Rheology) was then used to measure the kinetic viscoelastic modulus at 50° C. at a frequency of 11 Hz and a temperature elevation rate of 3° C./minute, and the storage elastic modulus was calculated.

(9) Storage Elastic Modulus and Loss Elastic Modulus at 50° C. or 23° C. of the Polishing Pad Upon Swelling to Saturation in 50° C. Hot Water The polishing pad thus obtained was cut to a length of 4 cm and a width of 0.5 cm to produce a sample. The thickness of the sample was measured by micrometer. Dipping in 50° C. hot water and nipping were repeated three times, after which the pad was soaked for 3 days in 50° C. hot water so that it swelled to saturation. The polishing pad was then removed from the hot water and any drops of water clinging to the surface were wiped off with a JK Wiper 150-S (made by Crecia). Then, the sample after the swelling treatment was put in a kinetic viscoelasticity measurement apparatus (DVE Rheospectora, made by Rheology) to find the storage elastic modulus at 50° C. or 23° C. ("E' (50° C., wet)"; "E' (23° C., wet)") at a frequency of 11 Hz and a temperature elevation rate of 3° C./minute, as well as the loss elastic modulus at 50° C., "E" (50° C., wet)".

(10) D Hardness, and D Hardness after Swelling in 50° C. Hot Water

The JIS D hardness of the polishing pad at 23° C. and 50° C. was measured according to JIS K 7311.

The polishing pad was cut to a length of 4 cm and a width of 0.5 cm, and dipping in 50° C. hot water and nipping were repeated three times, after which the pad was soaked for 3 days in 50° C. hot water. Immediately after the pad was taken out of the 50° C. hot water, any excess water drops the like on the outermost surface were wiped off with a JK Wiper 150-S (made by Crecia). The D hardness at 23° C., "D (23° C., wet)", for the sample that had undergone swelling to saturation in 50° C. hot water (hereinafter referred to as a water swollen sample) was measured as set forth in JIS K 7311.

(11) Existence of Communicating Pore Structure

The existence of a communicating pore structure was confirmed from whether or not water dropped onto the surface of the polishing pad went through communicating pores in the pad and appeared on the back side of the pad.

(12) Interlayer Separation Strength of Web Entangled Sheet

A test piece was produced by cutting a web entangled sheet that had yet to undergo wet heat shrinkage treatment to a length of 23 cm and a width of 2.5 cm as set forth in JIS K 6854-3. At one end of this test piece, a nick was made with a razor blade perpendicular to the thickness direction and in the center of the thickness direction, after which the piece was pulled apart about 100 mm by hand. The ends of the two separated portions thus obtained were chucked in a tensile tester. A stress-strain curve (SS curve) was obtained for when the test piece was pulled in the tensile tester at a pulling rate of 100 mm/minute, and the interlayer separation strength was found from the average stress of the flat portion of this curve. The average value when N=3 was termed the interlayer separation strength.

(13) Water Absorbency of Macromolecular Elastomer

A film 200 μm thick obtained by drying a macromolecular elastomer at 50° C. was heat treated for 30 minutes at 130° C., after which it was left for 3 days under conditions of 20° C. and 65% RH to obtain a dry sample, which was soaked in 23° C. water for 3 days. Any excess water drops or the like clinging to the outermost surface of the film immediately after it was taken out of the 23° C. water were wiped off with a JK Wiper 150-S (made by Crecia), which was used as a water swollen sample. The dry sample and the water swollen sample were both weighed, and the water absorbency was found from the following equation.

Water absorbency (%)=[(mass of the water swollen sample−mass of the dry sample)/(mass of the dry sample)]×100

(14) Water Absorbency of the Thermoplastic Resin Constituting the Ultrafine Fibers The thermoplastic resin that constituted the ultrafine fibers was hot pressed at a temperature of 20 to 100° C. over its melting point to obtain a film with a thickness of 200 μm, and this film was heat treated for 30 minutes at 130° C. After this, the film was left for 3 days under conditions of 20° C. and 65% RH to obtain a dry sample. The dry sample was soaked for 3 days in 23° C. water, any excess water drops or the like on the outermost surface of the film immediately after it was removed from the water were wiped off with a JK Wiper 150-S (made by Crecia), which was used as a water swollen sample. The dry sample and the water swollen sample were both weighed, and the water absorbency was found from the following equation.

Water absorbency (%)=[(mass of the water swollen sample−mass of the dry sample)/(mass of the dry sample)]×100

(15) Taber Abrasion Loss

The abrasion loss of the polishing pad was measured using an H-22 abrasion wheel at a load of 500 g and for 1000 passes, as set forth in JIS L 1096, section 8.17.3C (Taber format).

(16) Evaluation of Polishing Performance of Polishing Pad

Pressure-sensitive adhesive tape was affixed to the back of a circular polishing pad, after which the pad was mounted in a CMP apparatus ("PP0-60S," made by Nomura Seisakusho). Using a #325 diamond dresser (MEC325L, made by Mitsubishi Material), conditioning (seasoning) was performed by grinding the polishing pad surface for 18 minutes at a pressure of 177 kPa and a dresser speed of 110 rpm while distilled water was allowed to flow at a rate of 120 mL/minute.

Next, a silicon wafer with a diameter of six inches and having an oxidation film surface was polished for 100 seconds at a platen speed of 50 rpm, a head speed of 49 rpm, and a polishing pressure of 35 kPa, and while an abrasive slurry SS12 made by Cabot was supplied at a rate of 120 mL/minute. The thickness after polishing was then measured at any 49 points within the silicon wafer plane, and the polished thickness at each point was divided by the polishing time to find the polishing rate (nm/minute). The average value of the polishing rate at the 49 points was termed the polishing rate (R), and the standard deviation (σ) thereof was found.

Flatness was evaluated with the following equation. The smaller is the value for flatness, the better the flattening performance is.

Flatness (%)=(σ/R)×100

Next, the used polishing pad was left for 24 hours at 25° C. in a moist state. After this, seasoning was performed, and the same polishing was performed again, after which the polishing rate (R) and the flatness were found.

Seasoning and polishing were alternately repeated 300 times, and the polishing rate (R) and the flatness after the $300^{th}$ iteration were found.

Scratch resistance was evaluated by using a Surfscan SP1 wafer surface tester (made by KLA-Tencor) to measure the number of scratches that were at least 0.16 in size and present on the surface of the silicon wafer after each polishing.

The results are given in Tables 1 and 2.

TABLE 1

| | | Working Example Number | | | | | | | |
|---|---|---|---|---|---|---|---|---|---|
| | | 1 | 2 | 3 | 4 | 5 | 6 | 7 | 8 |
| Average cross sectional area of fibers | $\mu m^2$ | 7 | 6.5 | 7 | 6.5 | 7 | 7 | 8 | 7.4 |
| Average cross sectional area of fibers on pad surface | $\mu m^2$ | 7 | 6.5 | 7 | 6.5 | 7 | 7 | 8 | 7.4 |
| Density of fibers on pad surface | fibers/$mm^2$ | 3500 | 3200 | 4000 | 2100 | 2000 | 4000 | 2700 | 2400 |
| Bundling state of ultrafine fibers | — | yes | yes | yes | yes | yes | yes | yes | yes |
| Fiber bundle density in polishing pad cross section | bundles/$mm^2$ | 1500 | 1500 | 1800 | 1700 | 1800 | 1500 | 1500 | 1500 |
| Average cross sectional area of fiber bundles | $\mu m^2$ | 150 | 150 | 140 | 180 | 170 | 170 | 170 | 160 |
| Ratio of fiber bundles having at least 40 $\mu m^2$/bundle | % | 90 | 90 | 90 | 92 | 95 | 40 | 95 | 95 |
| Polishing pad fill ratio | % | 67 | 72 | 74 | 70 | 71 | 60 | 90 | 90 |
| Fiber-entangled body fill ratio | % | 46 | 45 | 51 | 44 | 51 | 56 | 67 | 68 |
| Polishing pad apparent density | — | 0.87 | 0.92 | 0.95 | 0.88 | 0.87 | 0.85 | 1.12 | 1.12 |
| Fiber-entangled body/macromolecular elastomer (mass. ratio) | | 73/27 | 69/31 | 74/26 | 69/31 | 77/23 | 85/15 | 58/42 | 58/42 |
| Water absorbency of polishing pad upon swelling to saturation at 50° C. | % | 16 | 18 | 15 | 16 | 19 | 29 | 5 | 7 |
| [E' (23° C., wet)/(E' (50° C., wet)] | | 1.5 | 1.5 | 1.5 | 1.4 | 1.4 | 1.4 | 1.4 | 1.4 |
| [E' (50° C., dry)/(E' (50° C., wet)] | | 1.6 | 1.2 | 1.6 | 1.4 | 1.4 | 1.5 | 1.1 | 1.1 |
| [E' (50° C., dry)] | MPa | 520 | 540 | 560 | 700 | 430 | 380 | 580 | 770 |
| [E' (50° C., wet)] | MPa | 320 | 450 | 350 | 500 | 310 | 250 | 410 | 700 |
| [E" (50° C., wet)] | MPa | 41 | 56 | 46 | 65 | 41 | 35 | 50 | 120 |
| D hardness (23° C.) | — | 62 | 63 | 63 | 64 | 62 | 56 | 64 | 65 |

TABLE 1-continued

| | | | | | | | | | | |
|---|---|---|---|---|---|---|---|---|---|---|
| D hardness (upon 50° C. swelling to saturation) | | — | 59 | 60 | 61 | 62 | 58 | 52 | 61 | 63 |
| Existence of communicating pore structure | | — | yes | yes | yes | yes | yes | yes | yes | yes |
| Interlayer separation strength of web entangled sheet | | kg/2.5 cm | 10 | 12 | 13 | 12 | 13 | 10 | 10 | 12 |
| Taber abrasion loss | | mg | 65 | 60 | 60 | 40 | 50 | 80 | 20 | 15 |
| Polishing rate: | (initial) | mm/min. | 190 | 200 | 210 | 220 | 200 | 200 | 170 | 170 |
| | (after 24 hours) | | 190 | 200 | 210 | 220 | 200 | 200 | 180 | 180 |
| | (after 300 times) | | 190 | 200 | 210 | 220 | 200 | 200 | 180 | 180 |
| Flatness: | (initial) | % | 4 | 3 | 4 | 5 | 5 | 4 | 5 | 5 |
| | (after 24 hours) | | 3 | 6 | 6 | 5 | 5 | 4 | 5 | 5 |
| | (after 300 times) | | 4 | 3 | 4 | 5 | 5 | 5 | 5 | 5 |
| Scratches: | (initial) | count | 12 | 13 | 12 | 12 | 12 | 10 | 22 | 20 |
| | (after 24 hours) | count | 10 | 9 | 11 | 12 | 12 | 12 | 19 | 24 |
| | (after 300 times) | count | 11 | 10 | 10 | 8 | 8 | 9 | 20 | 25 |

| | | | Working Example Number | | | | | | | |
|---|---|---|---|---|---|---|---|---|---|---|
| | | | 9 | 10 | 11 | 12 | 13 | 14 | 15 | 16 |
| Average cross sectional area of fibers | | $\mu m^2$ | 7 | 6.5 | 7 | 28 | 7 | 7.4 | 6.8 | 7 |
| Average cross sectional area of fibers on pad surface | | $\mu m^2$ | 7 | 6.5 | 7 | 28 | 7 | 7.4 | 6.8 | 7 |
| Density of fibers on pad surface | | fibers/$mm^2$ | 2000 | 2400 | 4200 | 700 | 3200 | 3000 | 3500 | 4500 |
| Bundling state of ultrafine fibers | | — | yes | yes | yes | yes | yes | yes | yes | yes |
| Fiber bundle density in polishing pad cross section | | bundles/$mm^2$ | 1000 | 1000 | 1500 | 1500 | 1150 | 1150 | 1500 | 1800 |
| Average cross sectional area of fiber bundles | | $\mu m^2$ | 150 | 100 | 170 | 150 | 150 | 150 | 150 | 150 |
| Ratio of fiber bundles having at least 40 $\mu m^2$/bundle | | % | 90 | 60 | 25 | 95 | 90 | 90 | 90 | 95 |
| Polishing pad fill ratio | | % | 58 | 58 | 62 | 70 | 71 | 70 | 67 | 74 |
| Fiber-entangled body fill ratio | | % | 35 | 35 | 46 | 45 | 40 | 45 | 46 | 51 |
| Polishing pad apparent density | | — | 0.73 | 0.72 | 0.8 | 0.88 | 0.82 | 0.8 | 0.82 | 0.95 |
| Fiber-entangled body/macromolecular elastomer (mass. ratio) | | | 65/35 | 67/33 | 78/22 | 69/31 | 68/32 | 66/34 | 74/26 | 74/26 |
| Water absorbency of polishing pad upon swelling to saturation at 50° C. | | % | 40 | 40 | 30 | 16 | 25 | 25 | 28 | 16 |
| [E' (23° C., wet)/(E' (50° C., wet)] | | | 1.5 | 1.6 | 1.5 | 1.5 | 2.5 | 2.4 | 2.5 | 1.7 |
| [E' (50° C., dry)/(E' (50° C., wet)] | | | 1.7 | 1.7 | 1.6 | 1.2 | 4.5 | 3 | 4.5 | 3 |
| [E' (50° C., dry)] | | MPa | 360 | 340 | 360 | 580 | 360 | 300 | 380 | 450 |
| [E' (50° C., wet)] | | MPa | 210 | 200 | 230 | 480 | 80 | 100 | 85 | 150 |
| [E'' (50° C., wet)] | | MPa | 30 | 25 | 34 | 60 | 9 | 13 | 9 | 25 |
| D hardness (23° C.) | | — | 54 | 52 | 54 | 64 | 54 | 54 | 50 | 61 |
| D hardness (upon 50° C. swelling to saturation) | | — | 50 | 49 | 50 | 62 | 50 | 50 | 40 | 54 |
| Existence of communicating pore structure | | — | yes | yes | yes | yes | yes | yes | yes | yes |
| Interlayer separation strength of web entangled sheet | | kg/2.5 cm | 10 | 12 | 10 | 12 | 10 | 12 | 13 | 13 |
| Taber abrasion loss | | mg | 120 | 120 | 140 | 40 | 65 | 60 | 60 | 90 |
| Polishing rate: | (initial) | mm/min. | 180 | 180 | 190 | 180 | 190 | 180 | 160 | 190 |
| | (after 24 hours) | | 180 | 180 | 180 | 180 | 190 | 180 | 140 | 160 |
| | (after 300 times) | | 180 | 170 | 180 | 170 | 180 | 170 | 130 | 150 |
| Flatness: | (initial) | % | 6 | 6 | 6 | 4 | 6 | 10 | 9 | 12 |
| | (after 24 hours) | | 6 | 6 | 6 | 5 | 6 | 10 | 15 | 15 |
| | (after 300 times) | | 6 | 6 | 6 | 5 | 7 | 11 | 18 | 16 |
| Scratches: | (initial) | count | 28 | 18 | 14 | 25 | — | — | 11 | 6 |
| | (after 24 hours) | count | 25 | 20 | 15 | 30 | — | — | 18 | 18 |
| | (after 300 times) | count | 24 | 18 | 15 | 30 | — | — | 27 | 24 |

TABLE 2

| | | Comparative Example Number | | | | | |
|---|---|---|---|---|---|---|---|
| | | 1 | 2 | 3 | 4 | 5 | 6 |
| Average cross sectional area of fibers | $\mu m^2$ | 1.6 | 15 | 15 | 300 | 20 | 7 |
| Average cross sectional area of fibers on pad surface | $\mu m^2$ | 1.6 | 15 | 15 | 300 | 20 | 7 |
| Density of fibers on polishing pad surface | fibers/$mm^2$ | 550 | 800 | 800 | 200 | 400 | 4000 |
| Bundling state of ultrafine fibers | — | yes | yes | yes | — | — | no |

TABLE 2-continued

| | | | | | | | | |
|---|---|---|---|---|---|---|---|---|
| Fiber bundle density in polishing pad cross section | | bundles/mm$^2$ | 300 | 300 | 300 | — | — | 1500 |
| Average cross sectional area of fiber bundles | | μm$^2$ | 180 | 200 | 180 | — | — | — |
| Ratio of fiber bundles having at least 40 μm$^2$/bundle | | % | 90 | 90 | 90 | — | — | 0 |
| Polishing pad fill ratio | | % | 58 | 38 | 40 | 61 | 45 | 46 |
| Fiber-entangled body fill ratio | | % | 35 | 23 | 25 | 49 | 30 | 46 |
| Polishing pad apparent density | | — | 0.73 | 0.65 | 0.76 | 0.8 | 0.66 | 0.76 |
| Fiber-entangled body/macromolecular elastomer (mass. ratio) | | | 55/45 | 50/50 | 74/26 | 85/15 | 50/50 | 84/16 |
| Water absorbency of polishing pad upon swelling to saturation at 50° C. | | % | 34 | 54 | 52 | 30 | 50 | 50 |
| [E' (23° C., wet)/(E' (50° C., wet)] | | | 1.5 | 1.5 | 1.5 | 1.4 | 1.6 | 1.6 |
| [(E' (50° C., dry))/(E' (50° C., wet)] | | | 2.4 | 2.6 | 2 | 1.4 | 2.7 | 2.8 |
| [(E' (50° C., dry)] | | MPa | 240 | 210 | 260 | 530 | 210 | 200 |
| [(E' (50° C., wet)] | | MPa | 100 | 80 | 130 | 380 | 80 | 70 |
| [(E" (50° C., wet)] | | MPa | 20 | 7 | 23 | 52 | 9 | 8 |
| D hardness (23° C.) | | — | 48 | 46 | 48 | 64 | 45 | 44 |
| D hardness (upon 50° C. swelling to saturation) | | — | 43 | 40 | 42 | 62 | 38 | 36 |
| Existence of communicating pore structure | | — | yes | yes | yes | yes | yes | no |
| Interlayer separation strength of web entangled sheet | | kg/2.5 cm | 4 | 4 | 4 | 12 | 2 | 10 |
| Taber abrasion loss | | mg | 160 | 170 | 160 | 35 | 250 | 300 |
| Polishing rate: | (initial) | mm/min. | 170 | 160 | 160 | 140 | 170 | 210 |
| | (after 24 hours) | | 160 | 160 | 160 | 140 | 160 | 190 |
| | (after 300 times) | | 150 | 150 | 150 | 140 | 150 | 190 |
| Flatness: | (initial) | % | 6 | 6 | 6 | 6 | 8 | 7 |
| | (after 24 hours) | | 9 | 9 | 9 | 6 | 10 | 9 |
| | (after 300 times) | | 10 | 10 | 10 | 6 | 14 | 12 |
| Scratches: | (initial) | count | 40 | 40 | 40 | 240 | 64 | 15 |
| | (after 24 hours) | count | 60 | 60 | 60 | 285 | 140 | 140 |
| | (after 300 times) | count | 75 | 75 | 75 | 315 | 210 | 390 |

| | | | Comparative Example Number | | | | | |
|---|---|---|---|---|---|---|---|---|
| | | | 7 | 8 | 9 | 10 | 11 | 12 |
| Average cross sectional area of fibers | | μm$^2$ | 6.5 | 7 | 6.5 | 7.5 | 300 | 7 |
| Average cross sectional area of fibers on pad surface | | μm$^2$ | 6.5 | 7 | 6.5 | 7.5 | 300 | 7 |
| Density of fibers on polishing pad surface | | fibers/mm$^2$ | 3800 | 4000 | 3600 | 4000 | 120 | 400 |
| Bundling state of ultrafine fibers | | — | no | no | no | no | — | yes |
| Fiber bundle density in polishing pad cross section | | bundles/mm$^2$ | 1500 | 1500 | 1500 | 1800 | — | 1500 |
| Average cross sectional area of fiber bundles | | μm$^2$ | — | 30 | 30 | 30 | — | 170 |
| Ratio of fiber bundles having at least 40 μm$^2$/bundle | | % | 0 | 5 | 5 | 5 | — | 99 |
| Polishing pad fill ratio | | % | 59 | 40 | 57 | 61 | 62 | 98 |
| Fiber-entangled body fill ratio | | % | 45 | 46 | 63 | 50 | 40 | 46 |
| Polishing pad apparent density | | — | 0.74 | 0.8 | 0.75 | 0.81 | 0.83 | 1.15 |
| Fiber-entangled body/macromolecular elastomer (mass. ratio) | | | 83/17 | 85/15 | 83/17 | 85/15 | 66/34 | 47/53 |
| Water absorbency of polishing pad upon swelling to saturation at 50° C. | | % | 33 | 50 | 34 | 30 | 28 | 1 |
| [E' (23° C., wet)/(E' (50° C., wet)] | | | 1.6 | 1.5 | 1.5 | 1.5 | 1.3 | 1.3 |
| [(E' (50° C., dry))/(E' (50° C., wet)] | | | 3 | 1.8 | 1.8 | 1.9 | 1.4 | 1.1 |
| [(E' (50° C., dry)] | | MPa | 180 | 210 | 180 | 160 | 370 | 800 |
| [(E' (50° C., wet)] | | MPa | 60 | 120 | 100 | 85 | 260 | 700 |
| [(E" (50° C., wet)] | | MPa | 5 | 23 | 9 | 9 | 38 | 90 |
| D hardness (23° C.) | | — | 44 | 54 | 56 | 52 | 55 | 65 |
| D hardness (upon 50° C. swelling to saturation) | | — | 37 | 40 | 40 | 44 | 53 | 65 |
| Existence of communicating pore structure | | — | yes | yes | yes | yes | yes | no |
| Interlayer separation strength of web entangled sheet | | kg/2.5 cm | 12 | 10 | 12 | 13 | 10 | 10 |
| Taber abrasion loss | | mg | 300 | 200 | 200 | 220 | 35 | 350 |
| Polishing rate: | (initial) | mm/min. | 220 | 190 | 210 | 190 | 160 | 150 |
| | (after 24 hours) | | 210 | 180 | 180 | 180 | 160 | 150 |
| | (after 300 times) | | 190 | 160 | 160 | 150 | 160 | 150 |

TABLE 2-continued

| | | | | | | | | |
|---|---|---|---|---|---|---|---|---|
| Flatness: | (initial) | % | 7 | 4 | 5 | 4 | 5 | 5 |
| | (after 24 hours) | | 9 | 7 | 7 | 7 | 5 | 5 |
| | (after 300 times) | | 12 | 12 | 12 | 12 | 5 | 5 |
| Scratches: | (initial) | count | 15 | 42 | 45 | 45 | 240 | 260 |
| | (after 24 hours) | count | 140 | 150 | 150 | 150 | 285 | 320 |
| | (after 300 times) | count | 390 | 285 | 285 | 285 | 315 | 340 |

The polishing pads of Working Examples 1 to 16 pertaining to the present invention had a high polishing rate and excellent flattening performance. The reasons for this are thought to be that stiffness is high during polishing, that ultrafine fibers appear on the polishing pad surface at a high fiber density, that the percentage of void is relatively low, and so on. Also, almost no decrease in polishing rate or flattening performance was noted over extended use. Furthermore, there was very little scratching. The reasons for this are thought to be that the ultrafine fibers appearing on the polishing pad surface play a cushioning role so that the agglomerated abrasive grains are not subjected to excessive load, that the fibers do not come loose, and so on.

On the other hand, with the polishing pads in Comparative Examples 1 to 3, which were obtained using a short fiber web instead of a long fiber web, the polishing rate and flattening performance were both low. Also, the polishing rate and flattening performance decreased significantly over extended use. This seems to be because stiffness was low during polishing, and there were fewer ultrafine fibers present on the polishing surface, among other factors.

Also, a great deal of scratching occurred in Comparative Examples 4 and 5, in which fiber bundles were not formed, in Comparative Examples 6 to 10, in which the ultrafine fibers were not bundled and in Comparative Example 11 in which standard fibers were used.

Working Example 17

Using the polishing pads obtained in Working Examples 1 to 3, the polishing performance was evaluated in the same manner, except that the polishing conditions were changed.

The polishing conditions were as follows.

(1) The silicon wafer was changed to a copper plate, the slurry used in polishing was changed to PL7101 made by Fujimi Incorporated (an addition of 30 cc of 35% aqueous hydrogen peroxide per 1000 g of slurry), and the slurry flow was changed to 200 mL/minute, with all else being the same.

(2) The silicon wafer was changed to a bare silicon wafer, with all else being the same.

(3) The slurry used in polishing was changed to Polishing Slurry GPL-C1010 made by Showa Denko, with all else being the same.

The results are shown in Table 3.

TABLE 3

| Polishing conditions | | | Type of polishing pad | | | | | | | | |
|---|---|---|---|---|---|---|---|---|---|---|---|
| | | | Polishing pad of Working Ex. 1 | | | Polishing pad of Working Ex. 2 | | | Polishing pad of Working Ex. 3 | | |
| | | | (1) | (2) | (3) | (1) | (2) | (3) | (1) | (2) | (3) |
| Polishing rate: | (initial) | mm/min. | 190 | 600 | 750 | 190 | 600 | 750 | 190 | 600 | 750 |
| | (after 24 hours) | | 190 | 600 | 750 | 190 | 600 | 750 | 190 | 600 | 750 |
| | (after 300 times) | | 190 | 600 | 750 | 190 | 600 | 750 | 190 | 600 | 750 |
| Flatness: | (initial) | % | 4 | 5 | 5 | 4 | 5 | 5 | 4 | 5 | 5 |
| | (after 24 hours) | | 4 | 4 | 5 | 4 | 5 | 5 | 4 | 5 | 5 |
| | (after 300 times) | | 4 | 5 | 5 | 4 | 5 | 5 | 4 | 5 | 5 |
| Scratches: | (initial) | count | — | — | 10 | — | — | 10 | — | — | 10 |
| | (after 24 hours) | count | — | — | 13 | — | — | 13 | — | — | 13 |
| | (after 300 times) | count | — | — | 14 | — | — | 14 | — | — | 14 |

As described in detail above, the polishing pad in one aspect of the present invention comprises a macromolecular elastomer and a fiber-entangled body formed from fiber bundles made up of ultrafine fibers whose average cross sectional area is between 0.01 and 30 $\mu m^2$, wherein part of the macromolecular elastomer is present in the interior of the fiber bundles, whereby the ultrafine fibers are bundled, the number of fiber bundles per unit of surface area present in a cross section in the thickness direction is at least 600 bundles per square millimeter, and the volumetric ratio of the portion excluding voids is between 55 and 95%. The above-mentioned polishing pad contains the fiber-entangled body formed from fiber bundles composed of ultrafine single fibers, and the ultrafine fibers that make up the fiber bundles are bundled by the macromolecular elastomer. The fiber bundles composed of ultrafine fibers bundled as above can maintain stiffness just as if they were a single thick fiber. Also, because the fiber density of the ultrafine fibers is high, the fiber bundles are, during polishing, split or fibrillated at the surface of the polishing pad, which forms ultrafine fibers of high fiber density on the surface. The ultrafine fibers formed on the polishing pad surface hold a uniform and large amount of abrasive grains, and a high contact surface area can be maintained with respect to the substrate being polished. Furthermore, the ultrafine fibers on the surface made the surface softer, so there is less scratching. And because the polishing pad has a high fill ratio, or in other words, because the percentage of void is low in the polishing pad, flattening performance can be improved. Also, since the polishing pad has a good hydrophilic property, the voids on the surface tend not to become clogged by the abrasive grains, so there is less fluctuation in polishing over time.

Consequently, a sufficient amount of abrasive slurry can be held in the ultrafine fibers. As a result, the polishing rate does not decrease even after extended use (this characteristic is also called polishing stability), and the polishing pad with high flattening performance is obtained.

Also, it is preferable for the pad to contain the fiber bundles whose cross sectional area is at least 40 $\mu m^2$ in terms of being able to maintain a sufficiently high stiffness in the polishing pad.

Also, in terms of maintaining higher stiffness, it is preferable that the ratio of the fiber bundles whose cross sectional area is at least 40 $\mu m^2$, out of the fiber bundles present in a cross section in the thickness direction, is at least 25%.

Also, in terms of obtaining the polishing pad with higher stiffness, it is preferable that the average cross sectional area of the fiber bundles present in a cross section in the thickness direction is at least 80 $\mu m^2$/bundle.

Also, it is preferable, in terms of obtaining superior abrasive grain retention and scratch resistance, that the ultrafine fibers are present on at least one surface in an amount of at least 600 fibers per square millimeter.

Also, in terms of forming texturing that is suitable for holding a sufficient amount of abrasive slurry on the polishing pad surface, it is preferable that the volumetric ratio of the portion excluding voids in the fiber-entangled body is at least 35%.

Also, in terms of more tightly bundling the ultrafine fibers, and thereby forming fiber bundles with higher stiffness, it is preferable that the macromolecular elastomer present in the interior of the fiber bundles is in a non-porous form in the polishing pad.

Also, in terms of allowing more abrasive slurry to be held, it is preferable that the polishing pad has a communicating pore structure.

Also, it is preferable for the water absorption height after 60 minutes to be at least 5 mm in a Byreck water absorbency test as set forth in JIS L 1907-1994. It is believed that the polishing pad will have favorable communicating pores if it has such water absorption characteristics.

Also, in terms of fewer changes over time in the mechanical properties of the polishing pad during polishing, it is preferable that the ultrafine fibers are formed from a thermoplastic resin whose glass transition temperature is at least 50° C. and whose water absorbency is no more than 4 mass %.

Also, in terms of fewer changes over time in the mechanical properties of the polishing pad during polishing, and of superior holding of the abrasive slurry, it is preferable that the water absorbency of the macromolecular elastomer in the polishing pad is between 0.5 and 8 mass %.

Also, it is preferable that the storage elastic modulus at 50° C., E' (50° C., dry), of the polishing pad is between 100 and 800 MPa, because sufficient stiffness will be maintained even if the temperature of the polishing pad rises due to frictional heat during polishing, and thus, higher flattening performance will be maintained.

Also, it is preferable in terms of further improving the holding of the abrasive slurry at the polishing pad surface that the water absorbency of the polishing pad upon swelling to saturation with 50° C. hot water is between 5 and 45 mass %.

Also, in terms of reducing deformation even when the temperature of the polishing pad rises due to frictional heat during polishing, it is preferable that the storage elastic modulus at 50° C. upon swelling to saturation with 50° C. hot water, "E' (50° C., dry)", of the polishing pad is between 100 and 800 MPa.

The method for manufacturing the polishing pad in another aspect of the present invention comprises a web manufacturing step of manufacturing a long fiber web composed of islands-in-the-sea type composite fibers obtained by the melt spinning of a water-soluble thermoplastic resin and a water-insoluble thermoplastic resin, a web entanglement step of forming a web entangled sheet by lapping a plurality of the long fiber webs and entangling them, a wet heat shrinkage treatment step of subjecting the web entangled sheet to wet heat shrinkage so that the surface area shrinkage ratio is at least 35%, a fiber-entangled body formation step of forming a fiber-entangled body composed of ultrafine fibers by dissolving the water-soluble thermoplastic resin in the web entangled sheet in hot water, and a macromolecular elastomer filling step of impregnating the fiber-entangled body with an aqueous solution of a macromolecular elastomer and then drying and solidifying. This manufacturing method gives the polishing pad in which the fiber density of the ultrafine fibers is high, and stiffness is high because the fiber bundles that are formed and the ultrafine fibers that make up these fiber bundles are respectively bundled tightly with each other by the macromolecular elastomer. Moreover, adjustment of voids correlated to the water absorbency in the polishing pad can be performed easily. Also, since the web entangled sheet containing the long fibers is subjected to a step of wet heat shrinkage, the web entangled sheet can be shrunken more than in a case where a web entangled sheet containing short fibers is subjected to wet heat shrinkage, which results in a higher fiber density of the ultrafine fibers.

Also, the above-mentioned method for manufacturing the polishing pad preferably further comprises a fiber bundle bonding step of bonding fiber bundles by impregnating with an aqueous solution of a macromolecular elastomer and then drying and solidifying, in which this step is inserted between the wet heat shrinkage treatment step and the fiber-entangled body formation step. Providing this step gives the polishing pad with a lower percentage of void.

Also, in the above-mentioned method for manufacturing the polishing pad, preferably the mass ratio between the water-soluble thermoplastic resin and the water-insoluble thermoplastic resin is from 5/95 to 50/50, because the fiber bundles composed of the ultrafine fibers of high fiber density will be obtained more readily.

Also, in the above-mentioned method for manufacturing the polishing pad, preferably the water-soluble thermoplastic resin is a polyvinyl alcohol resin. If the water-soluble thermoplastic resin is a polyvinyl alcohol resin, the ultrafine fibers that are formed will be greatly crimped when the polyvinyl alcohol resin is dissolved out of the islands-in-the-sea composite fibers. Consequently, the fiber density will be higher, so the fiber-entangled body with higher fiber density will be obtained.

INDUSTRIAL APPLICABILITY

The polishing pad pertaining to the present invention can be used to polish silicon wafers, semiconductor wafers, semiconductor devices, hard disks, glass substrates, optical products, various metals, and so forth.

The invention claimed is:

1. A polishing pad, comprising a fiber-entangled body that comprises fiber bundles, a macromolecular elastomer, and voids, wherein:

the fiber bundles comprise ultrafine fibers having an average cross sectional area between 0.01 and 30 $\mu m^2$, part of the macromolecular elastomer is present inside the fiber bundles, a number of fiber bundles per unit of surface area, present in a cross section in a thickness direction, is at least 600 bundles per square millimeter, and a volumetric ratio of a portion excluding voids in the polishing pad is between 55 and 95%, and a water absorbency of the macromolecular elastomer is between 0.5 and 8 wt %.

2. The polishing pad according to claim 1,comprising fiber bundles whose cross sectional area is at least 40 $\mu m^2$.

3. The polishing pad according to claim 1,wherein, out of the fiber bundles present in the cross section in the thickness direction, the proportion of fiber bundles whose cross sectional area is at least 40 $\mu m^2$ is at least 25%.

4. The polishing pad according to claim 1, wherein the average cross sectional area of the fiber bundles present in the cross section in the thickness direction is at least 80 $\mu m^2$ per bundle.

5. The polishing pad according to claim 1, wherein at least 600 ultrafine fibers per square millimeter are present on at least one surface.

6. The polishing pad according to claim 1, wherein the fiber-entangled body compromises voids, volumetric ratio of the portion excluding voids in the fiber-entangled body is at least 35%.

7. The polishing pad according to claim 1, wherein the macromolecular elastomer present inside the fiber bundles is in a non-porous form.

8. The polishing pad according to claim 1, wherein the polishing pad has a communicating pore structure.

9. The polishing pad according to claim 8, wherein the water absorption height after 60 minutes is at least 5 mm in a Byreck water absorbency test as set forth in JIS L 1907-1994.

10. The polishing pad according to claim 1, wherein the ultrafine fibers are formed from a thermoplastic resin whose glass transition temperature is at least 50° C. and whose water absorbency is not more than 4 wt %.

11. The polishing pad according to claim 1, wherein the water absorbency of the macromolecular elastomer is between 1 and 6 wt %.

12. The polishing pad according to claim 11, wherein the storage elastic modulus of the macromolecular elastomer at 150° C., E' (150° C., dry), is between 0.1 and 100 MPa.

13. The polishing pad according to claim 1, wherein the storage elastic modulus at 50° C., E' (50° C., dry), of the polishing pad is between 100 and 800 MPa.

14. The polishing pad according to claim 1, wherein the water absorbency of the polishing pad upon swelling to saturation with 50° C. hot water is between 5 and 45 wt %.

15. The polishing pad according to claim 1, wherein the storage elastic modulus at 50° C., E' (50° C., wet), of the polishing pad upon swelling to saturation with 50° C. hot water is between 100 and 800 MPa.

16. A method for manufacturing a polishing pad according to claim 1, the method comprising:

manufacturing a long fiber web formed of islands-in-the-sea type composite fibers obtained by the melt spinning of a water-soluble thermoplastic resin and a water-insoluble thermoplastic resin;

forming a web entangled sheet by lapping a plurality of the long fiber webs and entangling the same;

subjecting the web entangled sheet to wet heat shrinkage so that the surface area shrinkage ratio is at least 35%;

forming a fiber-entangled body formed of ultrafine fibers by dissolving in hot water the water-soluble thermoplastic resin in the web entangled sheet; and impregnating the fiber-entangled body with an aqueous solution of a macromolecular elastomer and then drying and solidifying the same.

17. The method according to claim 16, further comprising bonding fiber bundles by impregnating with an aqueous solution of a macromolecular elastomer and then drying and solidifying the same, wherein this bonding takes place after the wet heat shrinkage treatment and before the fiber-entangled body formation.

18. The method according to claim 16, wherein the mass ratio between the water-soluble thermoplastic resin and the water-insoluble thermoplastic resin is from 5/95 to 50/50.

19. The method according to claim 16, wherein the water-soluble thermoplastic resin is a polyvinyl alcohol resin.

20. The polishing pad of claim 1, wherein the number of fiber bundles per unit of surface area, present in a cross section in a thickness direction, is no more than 4000 bundles per square millimeter.

* * * * *